US011532894B2

(12) United States Patent
Kim et al.

(10) Patent No.: US 11,532,894 B2
(45) Date of Patent: Dec. 20, 2022

(54) ANTENNA APPARATUS

(71) Applicant: Samsung Electro-Mechanics Co., Ltd., Suwon-si (KR)

(72) Inventors: Sang Hyun Kim, Suwon-si (KR); Hyung Geun Ji, Suwon-si (KR); Se Min Jin, Suwon-si (KR); Won Cheol Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 215 days.

(21) Appl. No.: 16/735,994

(22) Filed: Jan. 7, 2020

(65) Prior Publication Data

US 2021/0036432 A1 Feb. 4, 2021

(30) Foreign Application Priority Data

Jul. 30, 2019 (KR) ..... 10-2019-0092231

(51) Int. Cl.
*H01Q 21/06* (2006.01)
*H01Q 21/00* (2006.01)
*H01Q 1/48* (2006.01)

(52) U.S. Cl.
CPC ..... *H01Q 21/065* (2013.01); *H01Q 1/48* (2013.01); *H01Q 21/0006* (2013.01)

(58) Field of Classification Search
CPC .. H01Q 1/2283; H01Q 1/38–48; H01Q 21/00; H01Q 21/065
See application file for complete search history.

(56) References Cited

U.S. PATENT DOCUMENTS 9,647,336 B2 * 5/2017 Legay ..... H01Q 3/46
10,446,923 B2 * 10/2019 Watson ..... H01Q 21/065
2003/0164797 A1 * 9/2003 Ngai ..... H01Q 1/523 343/700 MS (Continued)

FOREIGN PATENT DOCUMENTS

JP 2004-214820 A 7/2004

OTHER PUBLICATIONS

Wang et al., "Wideband High-Gain 60-GHz LTCC L-Probe Patch Antenna Array With a Soft Surface", IEEE Transactions on Antennas and Propagation, vol. 61, No. 4, Apr. 2013, pp. 1802-1809.

(Continued)

*Primary Examiner* — Hasan Islam
(74) *Attorney, Agent, or Firm* — NSIP Law

(57) ABSTRACT

An antenna apparatus includes a patch antenna pattern; a feed via electrically connected to the patch antenna pattern at a point offset in a first direction from a center of the patch antenna pattern; a first side coupling pattern spaced apart from the patch antenna pattern along a second direction and a second side coupling pattern spaced apart from the patch antenna pattern along the second direction and opposite to the first side coupling pattern; and a first side ground pattern spaced apart from the patch antenna pattern along the first direction and a second side ground pattern spaced apart from the patch antenna pattern along the first direction and opposite to the first side ground pattern. The patch antenna pattern and the first and second side coupling patterns are disposed between the first and second side ground patterns with respect to the first direction.

10 Claims, 23 Drawing Sheets

(56) References Cited

U.S. PATENT DOCUMENTS

| | | | | |
|---|---|---|---|---|
| 2004/0169605 | A1 | 9/2004 | Komatsu et al. | |
| 2007/0080864 | A1* | 4/2007 | Channabasappa | H01Q 13/18 343/700 MS |
| 2016/0190704 | A1* | 6/2016 | Celik | H01Q 9/0435 343/700 MS |
| 2018/0219272 | A1 | 8/2018 | Baheti et al. | |
| 2019/0089069 | A1* | 3/2019 | Niroo | H01Q 21/0025 |

OTHER PUBLICATIONS

Jang et al., "A 60-GHz Low-Profile, Wide-band, and High-Gain E-shaped Patch Array with Parasitic Patches", 2018, IEEE Radio and Wireless Symposium (RWS), pp. 42-44.

* cited by examiner

ANTENNA APPARATUS

CROSS-REFERENCE TO RELATED APPLICATIONS

This application claims the benefit under 35 USC 119(a) of Korean Patent Application No. 10-2019-0092231 filed on Jul. 30, 2019 in the Korean Intellectual Property Office, the entire disclosure of which is incorporated herein by reference for all purposes.

BACKGROUND

1. Field

The following description relates to an antenna apparatus

2. Description of Background

Mobile communications data traffic has increased on an annual basis. Various techniques have been developed to support the rapid increase in data in wireless networks in real time. For example, conversion of Internet of Things (IoT)-based data into contents, augmented reality (AR), virtual reality (VR), live VR/AR linked with SNS, an automatic driving function, applications such as a sync view (transmission of real-time images at a user viewpoint using a compact camera), and the like, may require communications (e.g., 5G communications, mmWave communications, and the like) which support the transmission and reception of large volumes of data.

Accordingly, there has been a large amount of research on mmWave communications including 5th generation (5G), and the research into the commercialization and standardization of an antenna apparatus for implementing such communications has been increasingly conducted.

A radio frequency (RF) signal of a high frequency band (e.g., 24 GHz, 28 GHz, 36 GHz, 39 GHz, 60 GHz, and the like) may easily be absorbed and lost during transmission, which may degrade quality of communications. Thus, an antenna for communications performed in a high frequency band may require a technical approach different from techniques used in a general antenna, and a special technique such as a separate power amplifier, and the like, may be required to secure antenna gain, integration of an antenna and a radio frequency integrated circuit (RFIC), effective isotropic radiated power (EIRP), and the like.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An antenna apparatus that may improve antenna performance (e.g., gain, bandwidth, directivity, etc.) and/or may be easily miniaturized.

In one general aspect, an antenna apparatus includes a patch antenna pattern; a feed via electrically connected to the patch antenna pattern at a point offset in a first direction from a center of the patch antenna pattern; a first side coupling pattern spaced apart from the patch antenna pattern along a second direction and a second side coupling pattern spaced apart from the patch antenna pattern along the second direction and opposite to the first side coupling pattern; and a first side ground pattern spaced apart from the patch antenna pattern along the first direction and a second side ground pattern spaced apart from the patch antenna pattern along the first direction and opposite to the first side ground pattern. The patch antenna pattern and the first and second side coupling patterns are disposed between the first and second side ground patterns with respect to the first direction.

The antenna apparatus may include a ground plane spaced apart from the patch antenna pattern along a third direction; and a plurality of ground connection vias electrically connecting the ground plane to the first and second side ground patterns.

At least one of the first and second side coupling patterns may be separated from the ground plane.

At least one of the first and second side coupling patterns may avoid blocking a region between at least a portion of the patch antenna pattern and the first and second side ground patterns in the first direction.

The antenna apparatus may include a plurality of side ground vias electrically connected to the first and second side ground patterns, and the first and second side ground patterns may be electrically connected to each other by the plurality of side ground vias.

The antenna apparatus may include an upper coupling pattern spaced apart from the patch antenna pattern along a third direction.

A width of each of the first and second side ground patterns in the first direction may be greater than a width of each of the first and second side coupling patterns in the second direction.

A spacing distance between each of the first and second side ground patterns and the patch antenna pattern in the first direction may be greater than a spacing distance between each of the first and second side coupling patterns and the patch antenna pattern in the second direction.

A length of each of the first and second side ground patterns in the second direction may be greater than a width of each of the first and second side ground patterns in the first direction, and a length of each of the first and second side coupling patterns in the first direction may be greater than a width of each of the first and second side coupling patterns in the second direction.

In another general aspect, an antenna apparatus includes a plurality of patch antenna patterns including M number of patch antenna patterns arranged in a first direction and N number of patch antenna patterns arranged in a second direction, where M and N are natural numbers; a plurality of side coupling patterns spaced apart from the plurality of patch antenna patterns in the second direction; and a side ground pattern blocking a region between the plurality of patch antenna patterns taken in the first direction and a region between the plurality of side coupling patterns taken in the first direction.

A width of the side ground pattern in the first direction may be greater than a width of each of the side coupling patterns in the second direction.

A spacing distance between the side ground pattern and each of the patch antenna patterns in the first direction may be greater than a spacing distance between each of the side coupling patterns and the patch antenna patterns in the second direction.

A length of the side ground pattern in the second direction may be greater than a distance from an end of a patch antenna pattern of the plurality of patch antenna patterns in the second direction, disposed on an end in the second direction, to another end of a patch antenna pattern in the second direction, disposed on another end in the second direction.

The antenna apparatus may include a ground plane spaced apart from the plurality of patch antenna patterns in a third direction; and a ground connection via electrically connecting the ground plane and the side ground pattern to each other.

At least one of the side coupling patterns is separated from the ground plane.

The antenna apparatus may include a plurality of feed vias, each feed via being electrically connected to a corresponding patch antenna pattern of the plurality of patch antenna patterns; and a plurality of feed lines, each feed line being electrically connected to a corresponding feed via of the plurality of feed vias and disposed perpendicularly to the corresponding feed via, and each of the feed lines may perpendicularly extend from the corresponding feed via.

The antenna apparatus may include a ground plane having at least one through-hole through which the plurality of feed vias penetrate, and the ground plane may be disposed between the plurality of feed lines and the plurality of patch antenna patterns.

At least one of M and N may be a natural number greater than or equal to 3, and a direction in which a feed line electrically connected to a patch antenna pattern of the plurality of patch antenna patterns disposed most adjacent to one corner of the ground plane extends may be perpendicular to a direction in which a feed line electrically connected to a patch antenna pattern of the plurality of patch antenna patterns disposed most adjacent to a center of the ground plane extends.

The antenna apparatus may include a plurality of first wiring vias, each first wiring via being electrically connected to a corresponding feed line of the plurality of feed lines; and an integrated circuit electrically connected to the plurality of first wiring vias.

In another general aspect, an antenna apparatus includes a patch antenna pattern; a first feed via electrically connected to the patch antenna pattern at a first point offset in a first direction from a center of the patch antenna pattern and extending in a second direction normal to the first direction; a second feed via electrically connected to the patch antenna pattern at a second point offset in a third direction from the center of the patch antenna pattern and extending in the second direction, wherein the third direction is normal to the first direction and the second direction; at least one first side coupling pattern spaced apart from the patch antenna pattern along the third direction and at least one second side coupling pattern spaced apart from the patch antenna pattern along the third direction and opposite to the at least one first side coupling pattern; and a first side ground pattern spaced apart from the patch antenna pattern along the first direction and a second side ground pattern spaced apart from the patch antenna pattern along the first direction and opposite to the first side ground pattern.

The antenna apparatus may include a first feed line extending from an end of the first feed via opposite to the first point in the third direction; and a second feed line extending from an end of the second feed via opposite to the second point in the first direction.

A length of the first side ground pattern in the third direction and a length of the second side ground pattern in the third direction may both be greater than a total distance from an outermost edge of the at least one first side coupling pattern in the third direction to an outermost edge of the at least one second side coupling pattern in the third direction.

A length of the at least one first side coupling pattern in the first direction and a length of the at least one second side coupling pattern in the first direction may both be greater than a length of the patch antenna pattern in the first direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
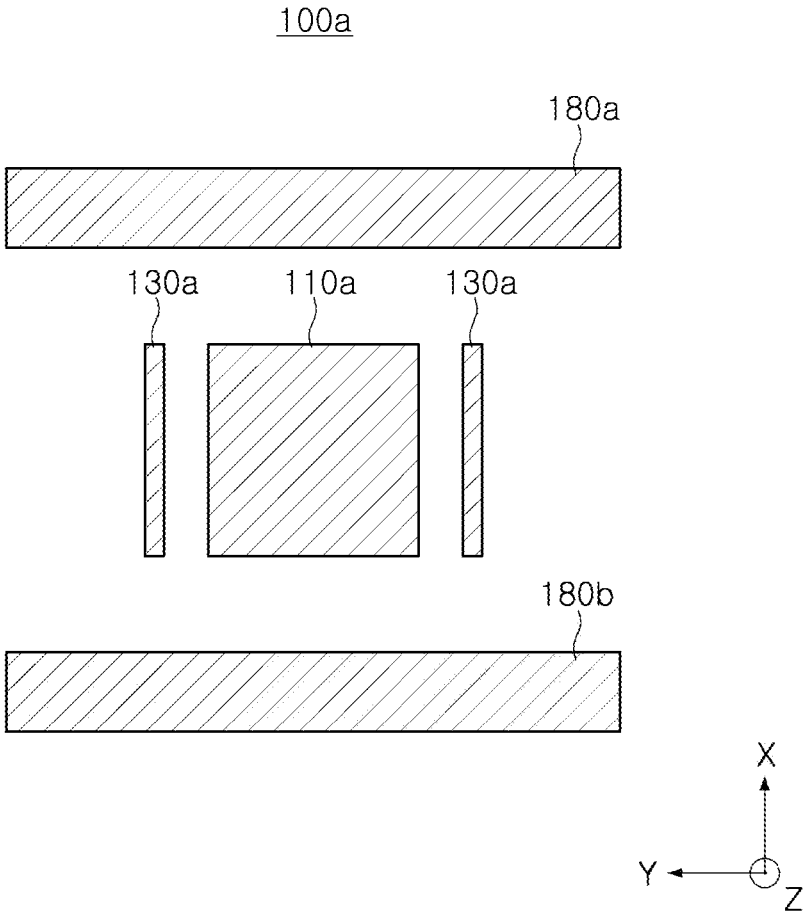
FIG. 1A is a plan view illustrating an antenna apparatus according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and examples are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative sizes, proportions, and depictions of elements in the drawings may be exaggerated for clarity, illustration, and convenience.

Hereinafter, examples will be described as follows with reference to the attached drawings.

Figure 1B:
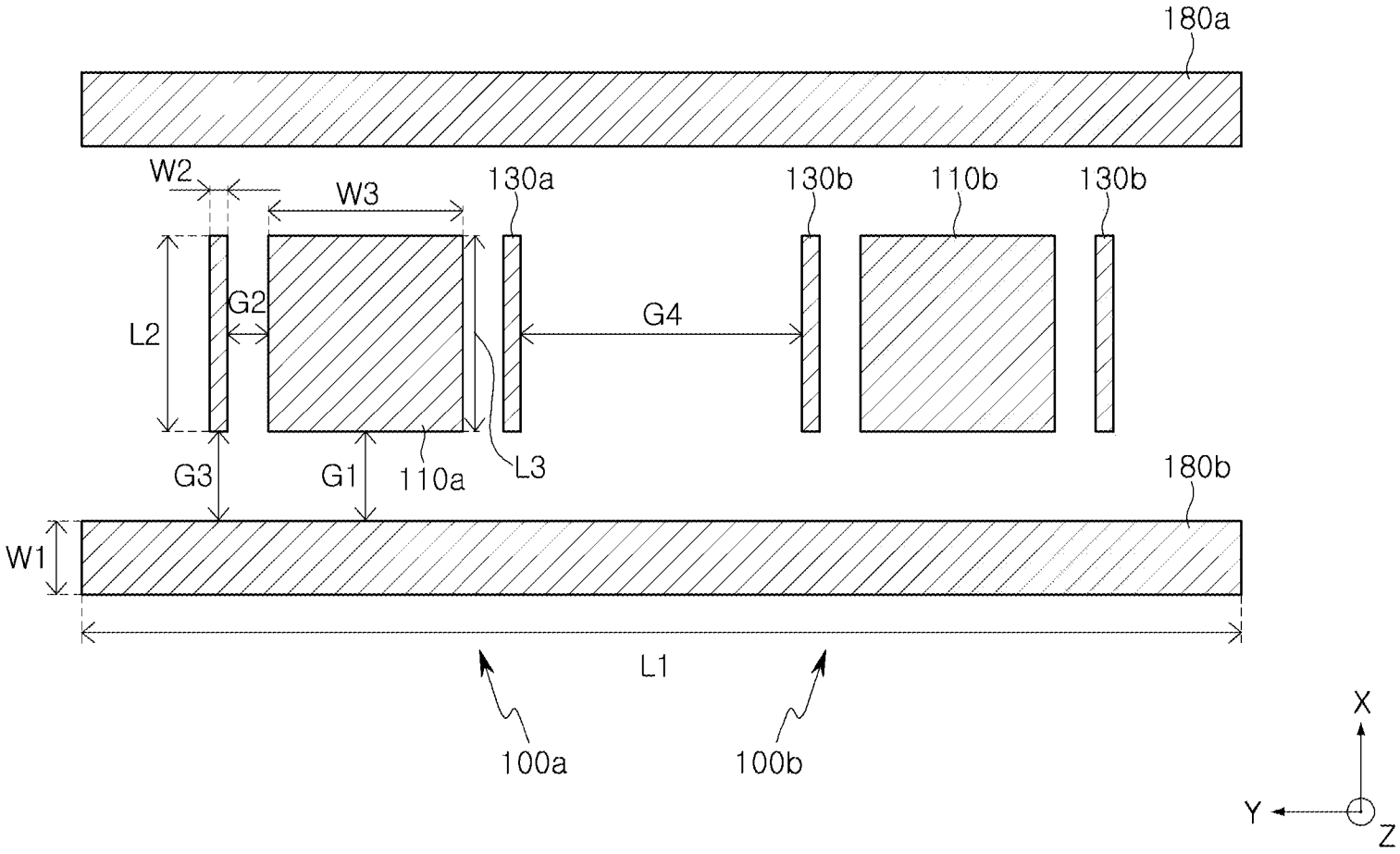
FIG. 1B is a plan view illustrating an arrangement of an antenna apparatus and a patch antenna pattern in a second direction (e.g., a Y direction) according to an example.
Figure 1C:
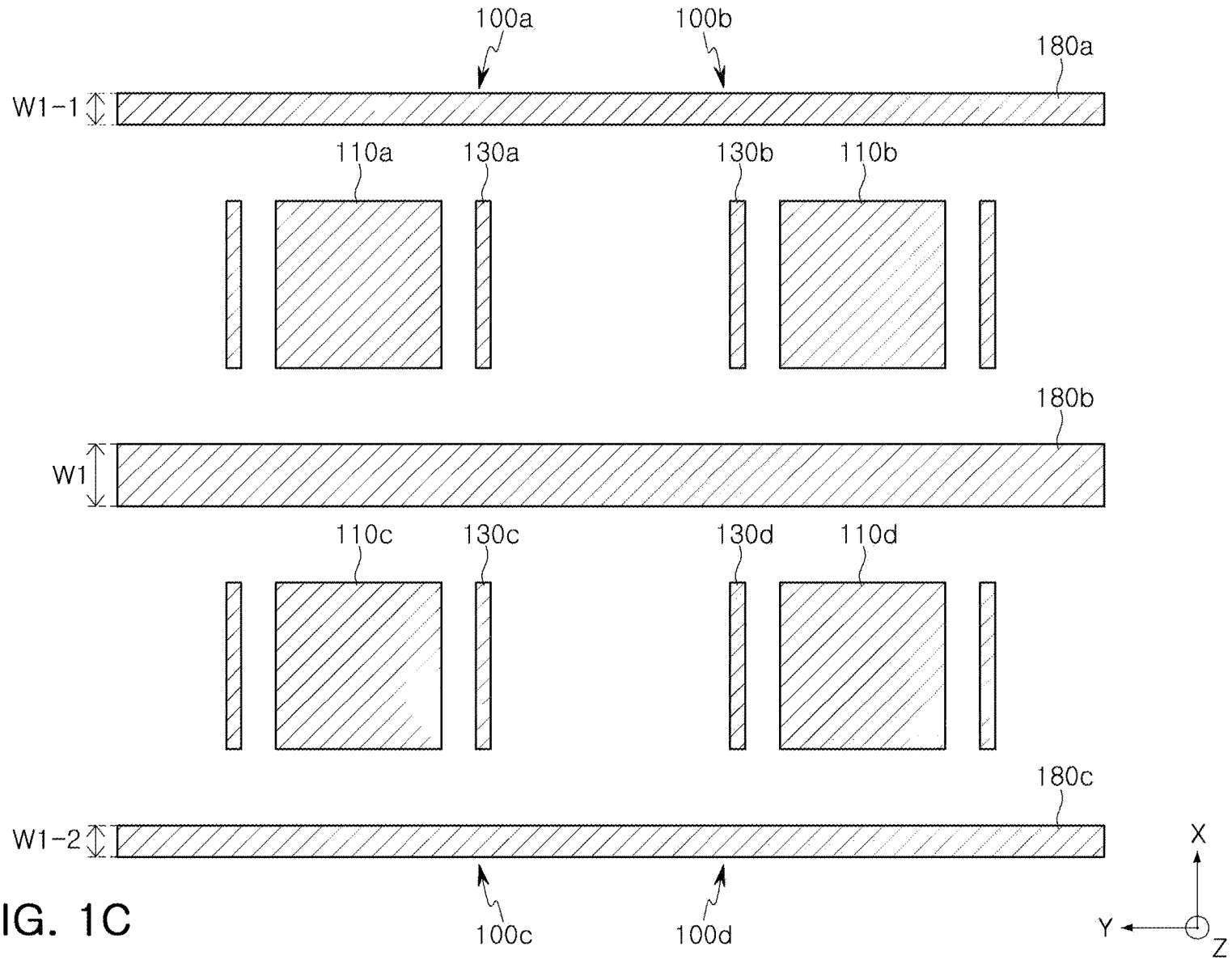
FIG. 1C is a plan view illustrating an arrangement of an antenna apparatus and a patch antenna pattern in a first direction (e.g., an X direction) and a second direction (e.g., a Y direction) according to an example.
Figure 2A:
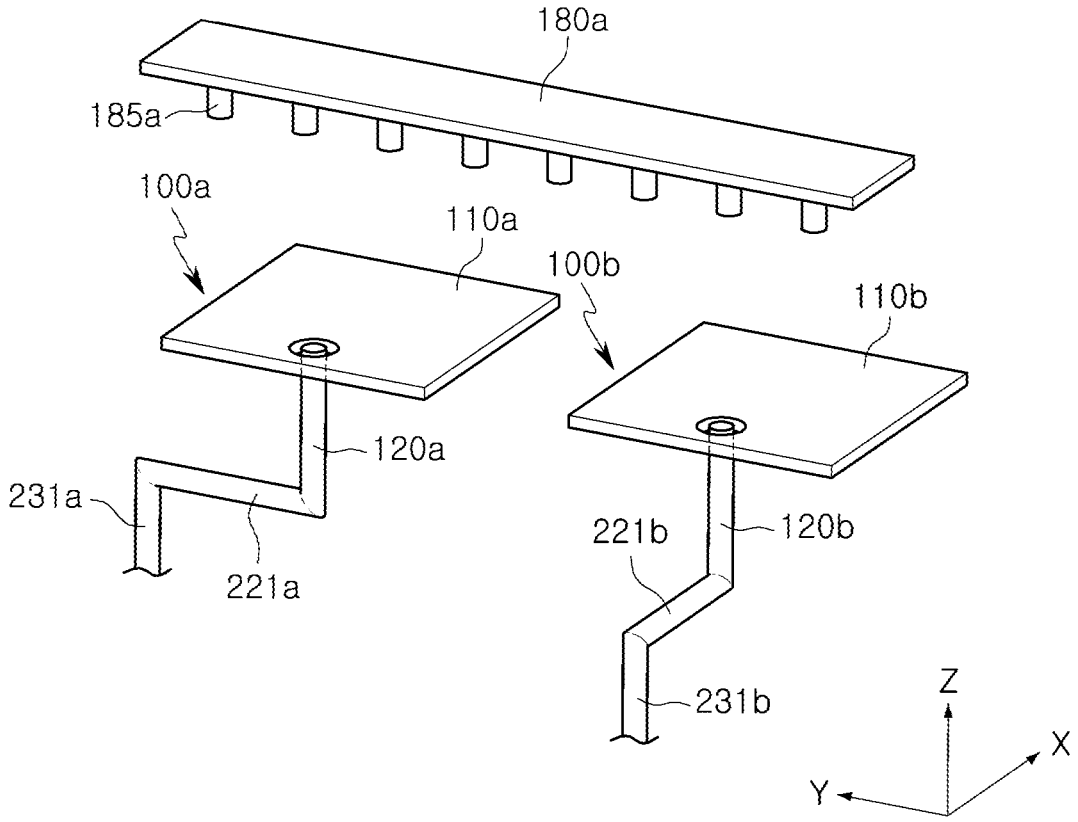
FIG. 2A is a perspective view illustrating an antenna apparatus according to an example.
Figure 2B:
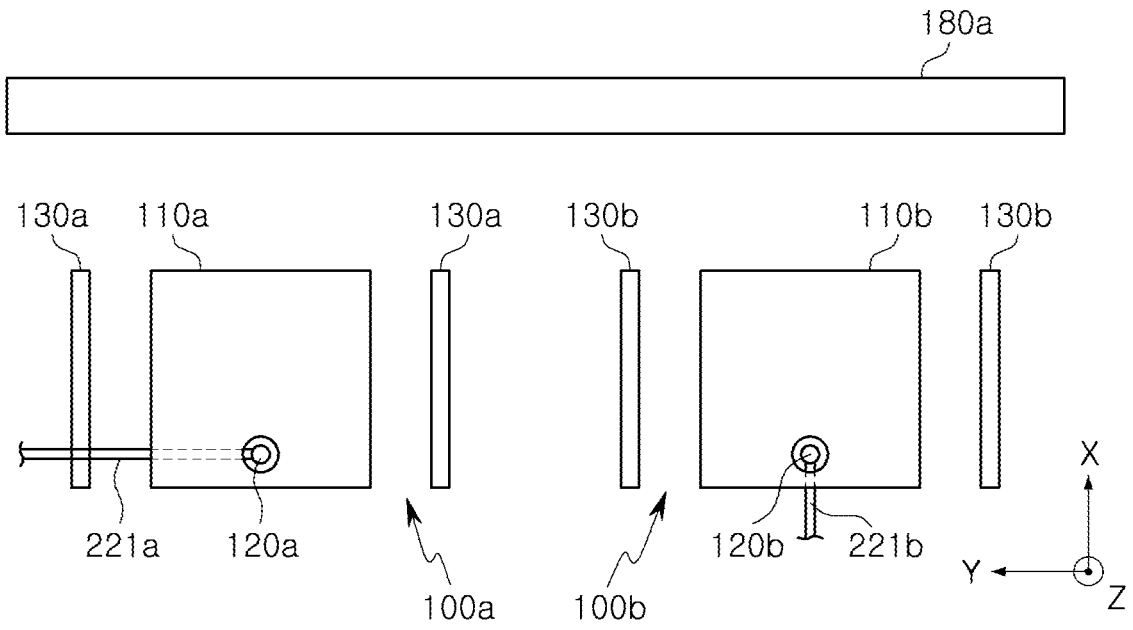
FIG. 2B is a plan view illustrating the antenna apparatus illustrated in FIG. 2A.

FIG. 1A is a plan view illustrating an antenna apparatus according to an example. FIG. 1B is a plan view illustrating an arrangement of an antenna apparatus and a patch antenna pattern in a second direction (e.g., a Y direction) according to an example. FIG. 2A is a perspective view illustrating an antenna apparatus according to an example. FIG. 2B is a plan view illustrating the antenna apparatus illustrated in FIG. 2A.

Referring to FIG. 1A, the antenna apparatus may include a first antenna unit 100*a*, and the first antenna unit 100*a* may include a patch antenna pattern 110*a*, a side coupling pattern 130*a*, and a side ground pattern 180*a*.

Referring to FIG. 1B, the antenna apparatus may further include a second antenna unit 100*b*, and the second antenna unit 100*b* may include a patch antenna pattern 110*b*, a side coupling pattern 130*b*, and a side ground pattern 180*b*.

Referring to FIGS. 2A and 2B, the antenna apparatus may include a plurality of first feed vias 120*a* and 120*b*, and may further include a plurality of first wiring vias 231*a* and 231*b*.

Each of the patch antenna patterns 110*a* and 110*b* may remotely transmit and receive a radio frequency (RF) signal, and may form a radiation pattern in upward and downward directions (e.g., a Z direction).

The RF signal may be transmitted from an integrated circuit (IC) to the patch antenna patterns 110*a* and 110*b* during transmission, and the RF signal may be transmitted from the patch antenna patterns 110*a* and 110*b* to an IC during reception.

The higher the number of the patch antenna patterns, such as patch antenna patterns 110*a* and 110*b*, the higher the gains of the patch antenna patterns 110*a* and 110*b*. However, the higher the number of the patch antenna patterns 110*a* and 110*b*, the more complex the electrical path between the patch antenna patterns 110*a* and 110*b* and an IC. The higher the complexity of the electrical path, the higher the overall transmission loss of the electrical path.

A phase difference of an RF signal between the patch antenna patterns 110*a* and 110*b* may be controlled by beam-forming control of an IC, or may be determined by an electrical length of an electrical path between the patch antenna patterns 110*a* and 110*b* and the IC. The closer the phase difference to a designed phase difference, the higher the gains and/or directivity of the patch antenna patterns 110*a* and 110*b* may be. The complexity of an electrical path between the patch antenna patterns 110*a* and 110*b* and the IC may be a factor which may cause the phase difference to be beyond the designed phase difference.

The first feed vias 120*a* and 120*b* may be electrically connected to corresponding patch antenna patterns of the patch antenna patterns 110*a* and 110*b*, respectively.

Accordingly, the patch antenna patterns 110*a* and 110*b* and a plurality of feed lines 221*a* and 221*b* may be disposed on different levels. Accordingly, a ratio of the number to a size of the patch antenna patterns 110*a* and 110*b* may decrease, and an electrical path between the patch antenna patterns 110*a* and 110*b* and the IC may be simplified. As the electrical path is simplified, an overall transmission loss of the electrical path may decrease, and the phase difference of the patch antenna patterns 110*a* and 110*b* may become close to a designed phase difference, thereby improving gains and/or directivity of the patch antenna patterns 110*a* and 110*b*.

For example, the first feed vias 120*a* and 120*b* may be connected to the patch antenna patterns 110*a* and 110*b* in the upward and downward directions (e.g., a Z direction).

An RF signal radiated from the patch antenna patterns 110*a* and 110*b* may be radiated in the upward and downward directions (e.g., a Z direction), perpendicular to a surface current. With reference to an upper side of the patch antenna patterns 110*a* and 110*b*, an electric field of the RF signal may be formed in a direction (e.g., an X direction) opposite to the first direction, and a magnetic field of the RF signal may be formed in the upward and downward directions (e.g., a Z direction) and a direction (e.g., a Y direction) opposite to the second direction and perpendicular to the first direction.

Gains and/or directivity of the patch antenna patterns 110*a* and 110*b* may increase when directions of the electric fields formed by the patch antenna patterns 110*a* and 110*b* are similar to each other, and directions of the magnetic fields of the patch antenna patterns 110*a* and 110*b* are similar to each other.

The first feed vias 120*a* and 120*b* may be electrically connected to points adjacent to one side taken in the first direction (e.g., an −X direction) from centers of the patch antenna patterns 110*a* and 110*b*, respectively.

Accordingly, an overall surface current of each of the patch antenna patterns 110*a* and 110*b* may flow in the first direction or a direction opposite to the first direction, and accordingly, similarity between directions of electric fields of the patch antenna patterns 110*a* and 110*b* and similarity between magnetic fields of the patch antenna patterns 110*a* and 110*b* may increase, and gains and/or directivity of the patch antenna patterns 110*a* and 110*b* may increase.

The side coupling patterns 130*a* and 130*b* may block a region between the patch antenna patterns 110*a* and 110*b*, and may be electromagnetically coupled to the patch antenna patterns 110*a* and 110*b*.

Accordingly, the side coupling patterns 130*a* and 130*b* may provide additional capacitance and/or inductance to the patch antenna patterns 110*a* and 110*b*. As the additional capacitance and/or inductance may work as an additional resonance frequency of the patch antenna patterns 110*a* and 110*b*, bandwidths of the patch antenna patterns 110*a* and 110*b* may be broadened.

The side coupling patterns 130*a* and 130*b* may be arranged in the second direction (e.g., a Y direction) along with the patch antenna patterns 110*a* and 110*b*.

Accordingly, the side coupling patterns 130*a* and 130*b* may support directions of surface currents of the patch antenna patterns 110*a* and 110*b* such that the directions of the surface currents may be stabilized, and gains and/or directivity of the side coupling patterns 130*a* and 130*b* may improve.

By including the side coupling patterns 130*a* and 130*b*, the directions of the surface currents of the patch antenna patterns 110*a* and 110*b* may be focused in the first direction or a direction opposite to the first direction.

For example, at least one of the side coupling patterns 130*a* and 130*b* may be configured to not block a region between at least a portion of the patch antenna patterns 110*a* and 110*b* and the side ground patterns 180*a* and 180*b* taken in the first direction.

Accordingly, the side coupling patterns 130*a* and 130*b* may stably support the directions of the surface currents of the patch antenna patterns 110*a* and 110*b*, and may increase a reinforcement interference ratio between the patch antenna patterns 110*a* and 110*b*, thereby improving gains and/or directivity of the patch antenna patterns 110*a* and 110*b*.

The more the surface current of each of the patch antenna patterns 110*a* and 110*b* is focused in the first direction or a direction opposite to the first direction, a direction of electromagnetic interference between adjacent patch antenna patterns of the patch antenna patterns 110*a* and 110*b* may be more focused in the first direction or a direction opposite to the first direction.

Accordingly, electromagnetic interference between the patch antenna patterns 110*a* and 110*b* spaced apart from each other in the second direction may decrease, and electromagnetic interference with a patch antenna pattern spaced apart from the patch antenna patterns 110*a* and 110*b* in the first direction (e.g., an X direction) or a direction opposite to the first direction may relatively increase.

Thus, the antenna apparatus may include the side ground patterns 180*a* and 180*b* spaced apart from the patch antenna patterns 110*a* and 110*b* in the first direction (e.g., an X direction) or a direction opposite to the first direction, respectively, and disposed such that the patch antenna patterns 110*a* and 110*b* and the side coupling patterns 130*a* and 130*b* are disposed between the side ground patterns 180*a* and 180*b* (along the X direction).

For example, the side ground patterns 180*a* and 180*b* may be electrically connected to a ground plane through a plurality of ground connection vias 185*a*, as illustrated in FIG. 2A.

As the side ground patterns 180*a* and 180*b* have ground property, an electromagnetic effect produced by electrical and/or magnetic fields of the patch antenna patterns 110*a* and 110*b* may be prevented from passing through the side ground patterns 180*a* and 180*b*.

Accordingly, electromagnetic interference of the patch antenna patterns 110*a* and 110*b* working in the first direction (e.g., an X direction) or a direction opposite to the first direction may be prevented.

Also, by including the side coupling patterns 130*a* and 130*b*, each of the patch antenna patterns 110*a* and 110*b* may have a widened bandwidth and may stably improve gains and/or directivity, and by including the side ground patterns 180*a* and 180*b*, electromagnetic interference between the patch antenna patterns 110*a* and 110*b* may be reduced.

Referring to FIG. 1B, each of the side ground patterns 180*a* and 180*b* may have a length L1 taken in the second direction, a width W1 taken in the first direction, a spacing distance G1 from the patch antenna patterns 110*a* and 110*b* taken in the first direction, and a spacing distance G3 from the side coupling patterns 130*a* and 130*b* taken in the first direction. Each of the side coupling patterns 130*a* and 130*b* may have a length L2 taken in the first direction, a width W2 taken in the second direction, and a spacing distance G4 therebetween taken in the second direction. Each of the patch antenna patterns 110*a* and 110*b* may have a length L3 taken in the first direction, a width W3 taken in the second direction, and a spacing distance G2 to the side coupling patterns 130*a* and 130*b* taken in the second direction.

As the side coupling patterns 130*a* and 130*b* are electromagnetically coupled to the patch antenna patterns 110*a* and 110*b*, sizes of the patch antenna patterns 110*a* and 110*b* may electromagnetically increase. Accordingly, when the width W2 of each of the side coupling patterns 130*a* and 130*b* is relatively narrow, a bandwidth of each of the patch antenna patterns 110*a* and 110*b* may be broadened.

The more the width W1 of each of the side ground patterns 180*a* and 180*b* taken in the first direction is widened, the side ground patterns 180*a* and 180*b* may more intensively prevent electromagnetic interference with the side coupling patterns 130*a* and 130*b* in the first direction and/or a direction opposite to the first direction.

Accordingly, the width W1 of each of the side ground patterns 180*a* and 180*b* taken in the first direction may be greater than the width W2 of each of the side coupling patterns 130*a* and 130*b* taken in the second direction.

The more the side coupling patterns 130*a* and 130*b* are disposed adjacent to the patch antenna patterns 110*a* and 110*b*, the side coupling patterns 130*a* and 130*b* may be more closely coupled to the patch antenna patterns 110*a* and 110*b*, and accordingly, the side coupling patterns 130*a* and 130*b* may support the patch antenna patterns 110*a* and 110*b* in an efficient manner.

The further the side ground patterns 180*a* and 180*b* are spaced apart from the patch antenna patterns 110*a* and 110*b*, it may be less likely that the side ground patterns 180*a* and 180*b* may become a medium for electromagnetic interference between the patch antenna patterns 110*a* and 110*b*.

Thus, the spacing distance G1 between the side ground patterns 180*a* and 180*b* and the patch antenna patterns 110*a* and 110*b* in the first direction may be longer than the spacing distance G2 between the side coupling patterns 130*a* and 130*b* and the patch antenna patterns 110*a* and 110*b* taken in the second direction.

The length L2 of each of the side coupling patterns 130*a* and 130*b* taken in the first direction may be configured to be longer than the width W2 taken in the second direction. Accordingly, the side ground patterns 180*a* and 180*b* may support directions of surface currents of the patch antenna patterns 110*a* and 110*b* in an efficient manner.

The length L1 of each of the side ground patterns 180*a* and 180*b* taken in the second direction may be configured to be longer than the width W1 taken in the first direction. Accordingly, the side ground patterns 180*a* and 180*b* may intensely prevent electromagnetic interference with the patch antenna patterns 110*a* and 110*b* working in the first direction and/or a direction opposite to the first direction, respectively, or the side ground patterns 180*a* and 180*b* may be prevented from being a medium for electromagnetic interference between the patch antenna patterns 110*a* and 110*b*.

The length L1 of each of the side ground patterns 180*a* and 180*b* taken in the second direction may be longer than a distance (W3+G2+W2+G4+W2+G2+W3) between an end of a patch antenna pattern of the patch antenna patterns 110*a* and 110*b* taken in the second direction, disposed on an end taken in the second direction, to the other end of a patch antenna pattern taken in the second direction, disposed on the other end taken in the second direction.

Accordingly, an electromagnetic environment of the patch antenna pattern of the patch antenna patterns 110*a* and 110*b* disposed on an end or the other end taken in the second direction may be similar to an electromagnetic environment of the patch antenna pattern of the patch antenna patterns 110*a* and 110*b* disposed at a center taken in the second direction, and accordingly, the patch antenna patterns 110*a* and 110*b* may effectively form a radiation pattern.

FIG. 10 is a plan view illustrating an arrangement of an antenna apparatus and a patch antenna pattern in a first direction (e.g., an X direction) and a second direction (e.g., a Y direction) according to an example.

Referring to FIG. 10, the antenna apparatus may include first, second, third, and fourth antenna units 100*a*, 100*b*, 100*c*, and 100*d*, and the first, second, third, and fourth antenna units 100*a*, 100*b*, 100*c*, and 100*d* may include a plurality of patch antenna patterns 110*a*, 110*b*, 110*c*, and 110*d*, a plurality of side coupling patterns 130*a*, 130*b*, 130*c*, and 130*d*, and a plurality of side ground patterns 180*a*, 180*b*, and 180*c*. The side ground patterns 180*a*, 180*b*, and 180*c* may have widths W1-1, W1, and W1-2 taken in the first direction, respectively.

Among the patch antenna patterns 110*a*, 110*b*, 110*c*, and 110*d*, M number of patch antenna patterns may be arranged in the first direction, and N number of patch antenna patterns may be arranged in the second direction. M and N may be natural numbers.

The higher the number of the patch antenna patterns 110*a*, 110*b*, 110*c*, and 110*d*, the more electromagnetically efficient the M×N arrangement structure may be. Thus, the antenna apparatus in the example may efficiently increase energy of an RF signal remotely transmitted and received, and may thus efficiently support communications of an electric device (e.g., a communication device at a base station) requiring a relatively large output during communication.

The side coupling patterns 130*a*, 130*b*, 130*c*, and 130*d* may be spaced apart from the patch antenna patterns 110*a*, 110*b*, 110*c*, and 110*d* in the second direction (e.g., a Y direction), respectively.

Accordingly, in the antenna apparatus, even when the number of the patch antenna patterns 110*a*, 110*b*, 110*c*, and 110*d* increases, radiation patterns of the patch antenna patterns 110*a*, 110*b*, 110*c*, and 110*d* may be combined in an efficient manner.

The side ground patterns 180*a*, 180*b*, and 180*c* may be disposed to block a region between the antenna patterns 110*a*, 110*b*, 110*c*, and 110*d* taken in the first direction (e.g., an X direction) and a region between the side coupling patterns 130*a*, 130*b*, 130*c*, and 130*d* taken in the first direction (e.g., an X direction) together.

For example, the side ground pattern 180*b* may be a region in which electromagnetic interference factors (e.g., a surface current induced by an electric field/a magnetic field) of the first, second, third, and fourth antenna units 100*a*, 100*b*, 100*c*, and 100*d* meet one another. As spacing distances to the first, second, third, and fourth antenna units 100*a*, 100*b*, 100*c*, and 100*d* are symmetrical to each other with reference to the side ground pattern 180*b* at a center, the side ground pattern 180*b* at a center may effectively offset the electromagnetic interference factors of the first, second, third, and fourth antenna units 100*a*, 100*b*, 100*c*, and 100*d*.

Accordingly, in the antenna apparatus, even when the number of the patch antenna patterns 110*a*, 110*b*, 110*c*, and 110*d* increases, electromagnetic interference between the patch antenna patterns 110*a*, 110*b*, 110*c*, and 110*d* may be reduced.

Figure 1D:
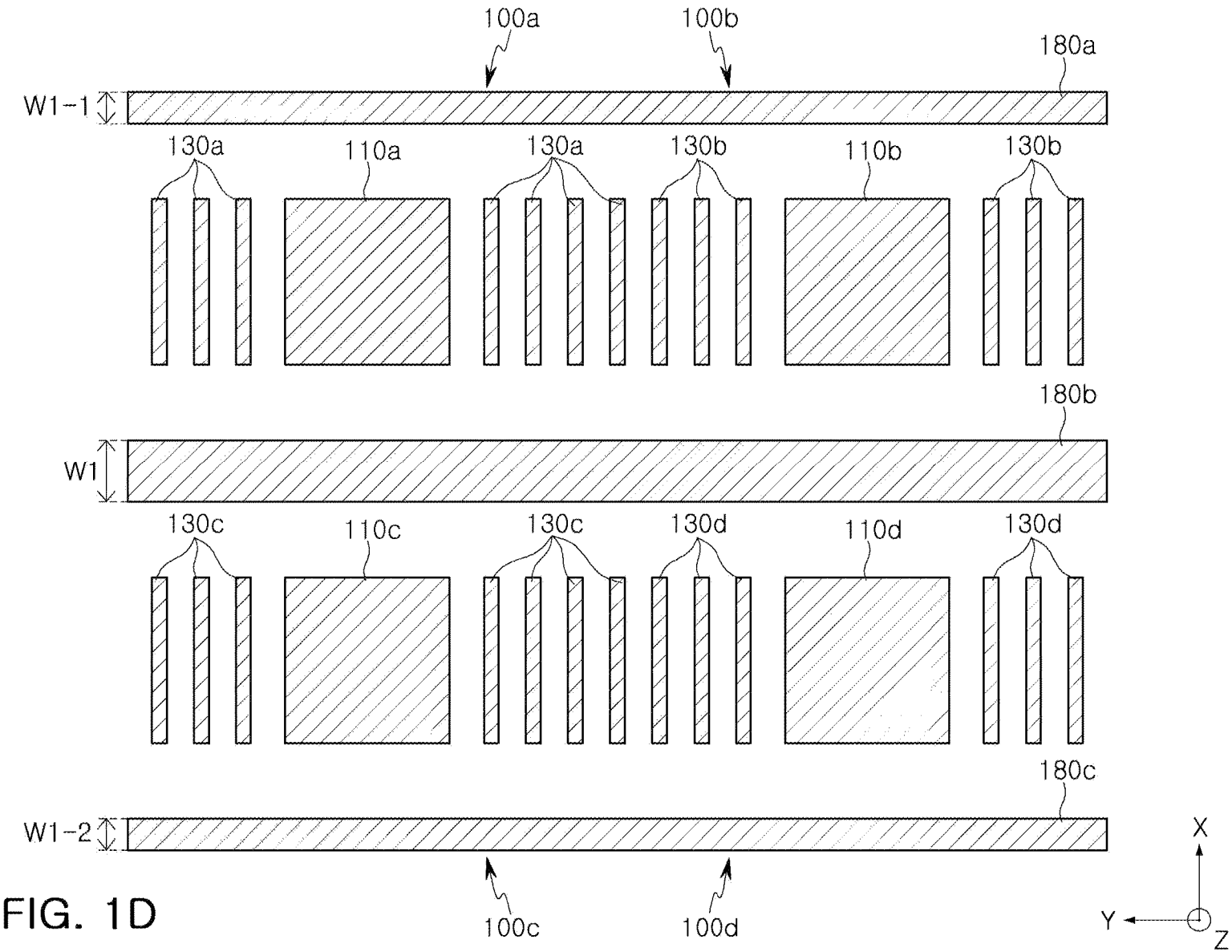
FIG. 1D is a plan view illustrating an additional arrangement of an antenna apparatus and a side coupling pattern according to an example.

FIG. 1D is a plan view illustrating an additional arrangement of an antenna apparatus and a side coupling pattern according to an example.

Referring to FIG. 1D, the number of the side coupling patterns 130*a*, 130*b*, 130*c*, and 130*d* may be greater than 2.

For example, when repeatability in arrangement of the side coupling patterns 130*a*, 130*b*, 130*c*, and 130*d* increases, resonance with respect to a certain frequency may occur in the side coupling patterns 130*a*, 130*b*, 130*c*, and 130*d*, and accordingly, the side coupling patterns 130*a*, 130*b*, 130*c*, and 130*d* may be electromagnetically coupled to the patch antenna patterns 110*a*, 110*b*, 110*c*, and 110*d* more intensively at a certain frequency.

Figure 1E:
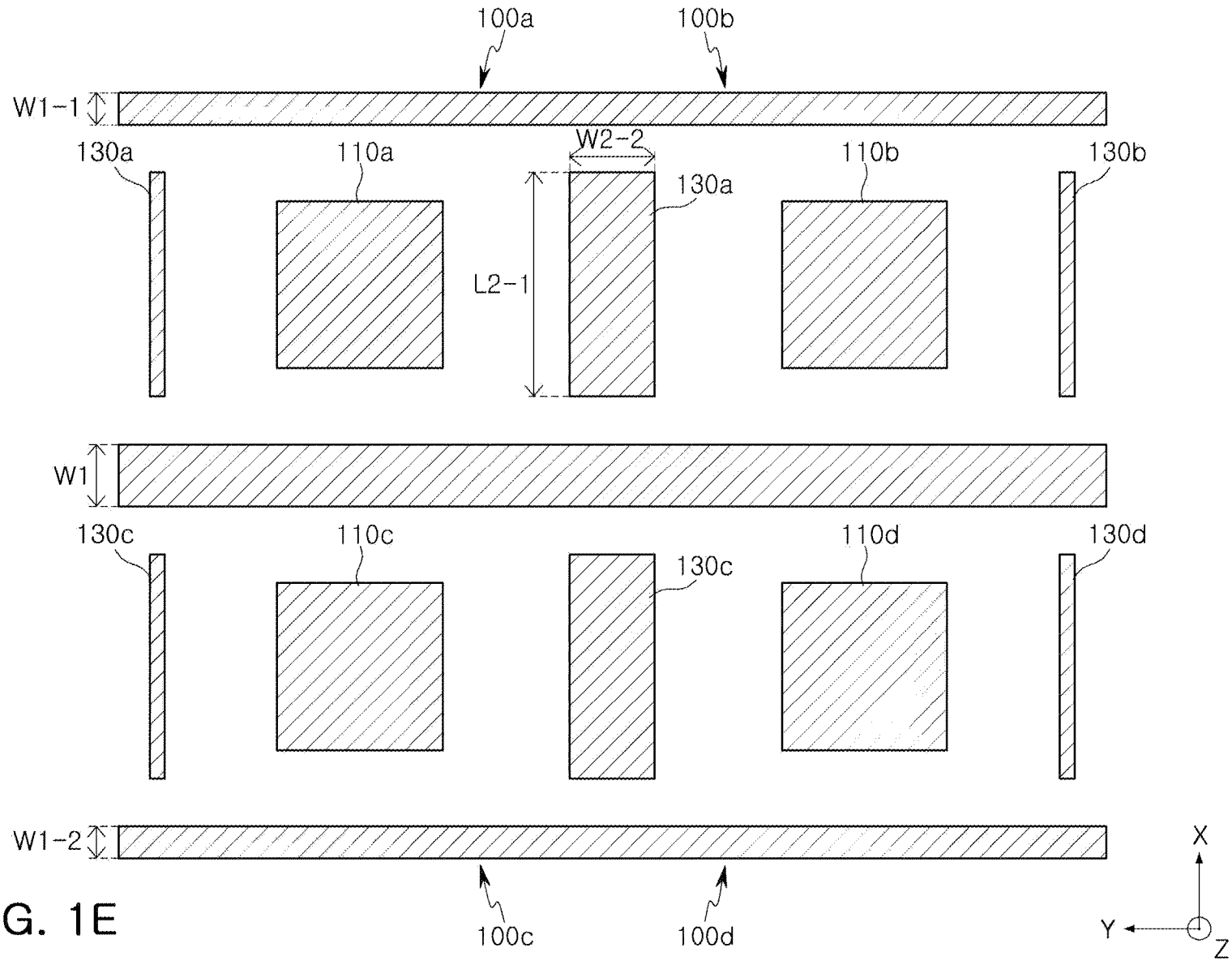
FIG. 1E is a plan view illustrating a modified structure of an antenna apparatus and a side coupling pattern according to an example.

FIG. 1E is a plan view illustrating a modified structure of an antenna apparatus and a side coupling pattern according to an example.

Referring to FIG. 1E, a length L2-1 of one or more of the side coupling patterns 130*a*, 130*b*, 130*c*, and 130*d* taken in the first direction may be longer than a length of the side coupling patterns illustrated in FIGS. 1A to 1D taken in the first direction, and a width W2-2 of one or more of the side coupling patterns 130*a*, 130*b*, 130*c*, and 130*d* taken in the second direction may be greater than a width of the side coupling patterns illustrated in FIGS. 1A to 1D taken in the second direction.

The length L2-1 taken in the first direction and the width W2-2 taken in the second direction of one or more of the side coupling patterns 130*a*, 130*b*, 130*c*, and 130*d* may be varied.

FIG. 2A is a perspective view illustrating an antenna apparatus according to an example. FIG. 2B is a plan view illustrating the antenna apparatus illustrated in FIG. 2A.

Referring to FIGS. 2A and 2B, the first feed lines 221*a* and 221*b* may be electrically connected to corresponding first feed vias of the first feed vias 120*a* and 120*b*, respectively. The first feed lines 221*a* and 221*b* may electrically connect the first feed vias 120*a* and 120*b* and the first wiring vias 231*a* and 231*b* to each other and may work as an electrical path of an RF signal. The first wiring vias 231*a* and 231*b* may electrically connect an IC to the first feed lines 221*a* and 221*b*.

For example, the first feed lines 221*a* and 221*b* may be disposed to form an X-Y plane.

A direction of electrical connection of the first feed lines 221*a* and 221*b* to the first feed vias 120*a* and 120*b* may correspond to a transmission direction of an RF signal in the first feed lines 221*a* and 221*b*.

An electrical connection point between the first feed lines 221*a* and 221*b* and the first feed vias 120*a* and 120*b* may correspond to a point at which a direction in which an RF signal is transmitted is turned from a horizontal direction (e.g., an X direction and/or a Y direction) to the upward and downward directions (e.g., a Z direction).

It may be difficult to change a direction in which an RF signal is transmitted because properties of an RF signal may be close to light properties when a frequency of the RF signal increases. Accordingly, an RF signal transmitted from the first feed vias 120*a* and 120*b* may include a vector element corresponding to a transmission direction of an RF signal of the first feed lines 221*a* and 221*b*.

The vector element may gradually turn into a vector element working in upward and downward directions, an extending direction of the first feed vias 120*a* and 120*b*, from an electrical connection point between the first feed lines 221*a* and 221*b* and the first feed vias 120*a* and 120*b*, and may remain in the patch antenna patterns 110*a* and 110*b*. The shorter the electrical length of each of the first feed vias 120*a* and 120*b*, the more the energy of a vector element corresponding to a transmission direction of an RF signal of the first feed lines 221*a* and 221*b* may increasingly remain in the patch antenna patterns 110*a* and 110*b*.

Accordingly, a direction of a surface current flowing on the patch antenna patterns 110*a* and 110*b* may be slightly affected by a direction of electrical connection of the first feed lines 221*a* and 221*b* to the first feed vias 120*a* and 120*b*.

The first feed lines 221*a* and 221*b* may extend from corresponding first feed vias 120*a* and 120*b* in a direction in which the first feed lines 221*a* and 221*b* do not form an angle of 0° or 180° with the corresponding first feed vias 120*a* and 120*b*.

For example, the first feed line 221*a* of the first antenna unit 100*a* may be electrically connected to the first feed via 120*a* in the second direction (e.g., a Y direction), and the first feed line 221*b* of the second antenna unit 100*b* may be electrically connected to the first feed via 120*b* in the first direction (e.g., an X direction).

Accordingly, a first effect of a direction of electrical connection between the first feed line 221*a* of the first antenna unit 100*a* and the first feed via 120*a*, affecting a surface current of the patch antenna pattern 110*a*, may be different from a second effect of a direction of electrical connection between the first feed line 221*b* of the second antenna unit 100*b* and the first feed via 120*b*, affecting a surface current of the patch antenna pattern 110*b*.

As the first effect and the second effect are different from each other, a side lobe generated in the patch antenna patterns 110*a* and 110*b* may be removed or reduced.

Figure 2C:
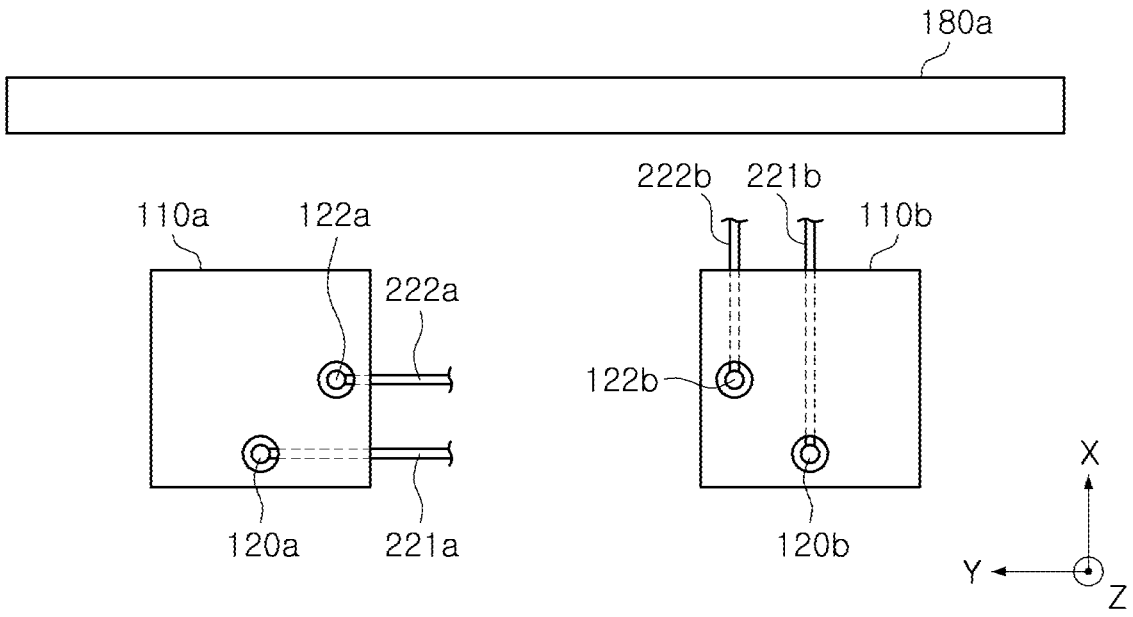
FIG. 2C is a plan view illustrating a polarized wave implementation structure of an antenna apparatus according to an example.

FIG. 2C is a plan view illustrating a polarized wave implementation structure of an antenna apparatus according to an example.

Referring to FIG. 2C, the antenna apparatus may further include a plurality of second feed vias 122*a*, 122*b* and a plurality of second feed lines 222*a* and 222*b*.

The second feed vias 122*a* and 122*b* may be electrically connected to corresponding patch antenna patterns of the patch antenna patterns 110*a* and 110*b*, respectively, and may be electrically connected to points adjacent to one side taken in the second direction (e.g., a Y direction) from centers of the corresponding patch antenna patterns, respectively.

Accordingly, an overall second surface current of the patch antenna patterns 110*a* and 110*b* corresponding to the second feed vias 122*a* and 122*b* may flow in the second direction (e.g., a Y direction), and may flow in a direction perpendicular to a first surface current corresponding to the first feed vias 120*a* and 120*b*.

When the first and second surface currents are perpendicular to each other, first and second electric fields corresponding to the first and second surface currents, respectively, may be perpendicular to each other, and first and second magnetic fields corresponding to the first and second surface currents, respectively, may be perpendicular to each other.

Accordingly, RF signals transmitted through the first feed vias 120*a* and 120*b* and RF signals transmitted through the second feed vias 122*a* and 122*b* may be remotely transmitted and received in parallel, without interference between the RF signals.

The second feed lines 222*a* and 222*b* may be electrically connected to corresponding second feed vias of the second feed vias 122*a* and 122*b*, and may extend from the corresponding second feed vias in a direction in which the second feed lines 222*a* and 222*b* may not form an angle of 0° or 180° with the corresponding second feed vias.

Accordingly, a side lobe generated in the patch antenna patterns 110*a* and 110*b* may be removed or reduced effectively.

Figure 2D:
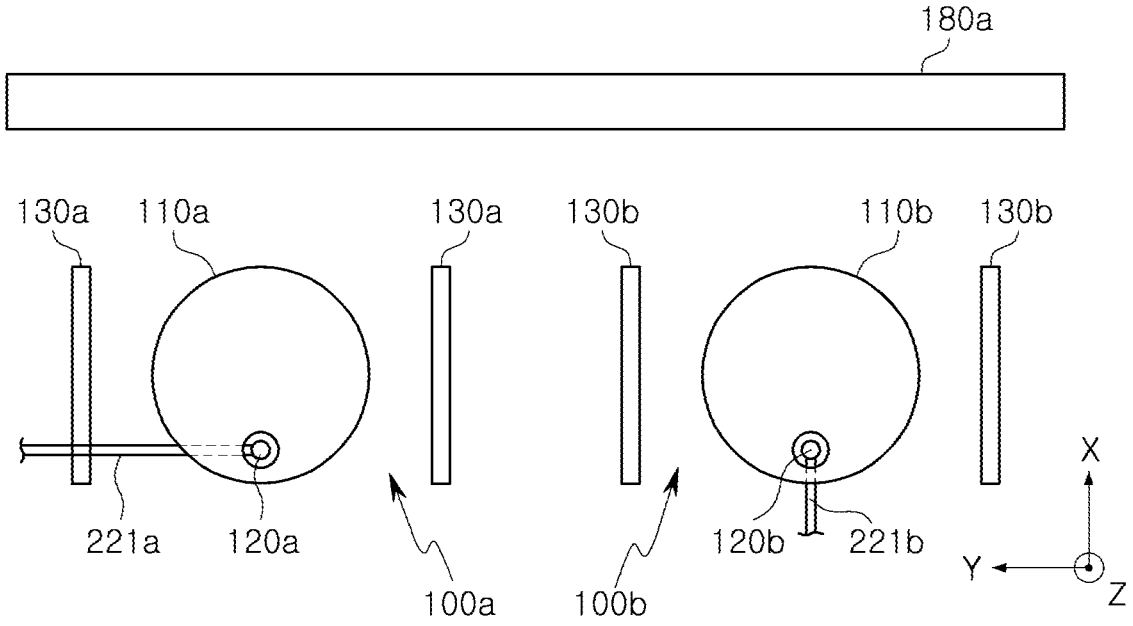
FIG. 2D is a plan view illustrating a modified structure of a patch antenna pattern of an antenna apparatus according to an example.

FIG. 2D is a plan view illustrating a modified structure of a patch antenna pattern of an antenna apparatus according to an example.

Referring to FIG. 2D, each of the patch antenna patterns 110*a* and 110*b* may have a circular shape.

Referring to FIGS. 2A through 2D, each of the patch antenna patterns 110*a* and 110*b* may have a polygonal shape or a circular shape in the various examples.

Figure 3A:
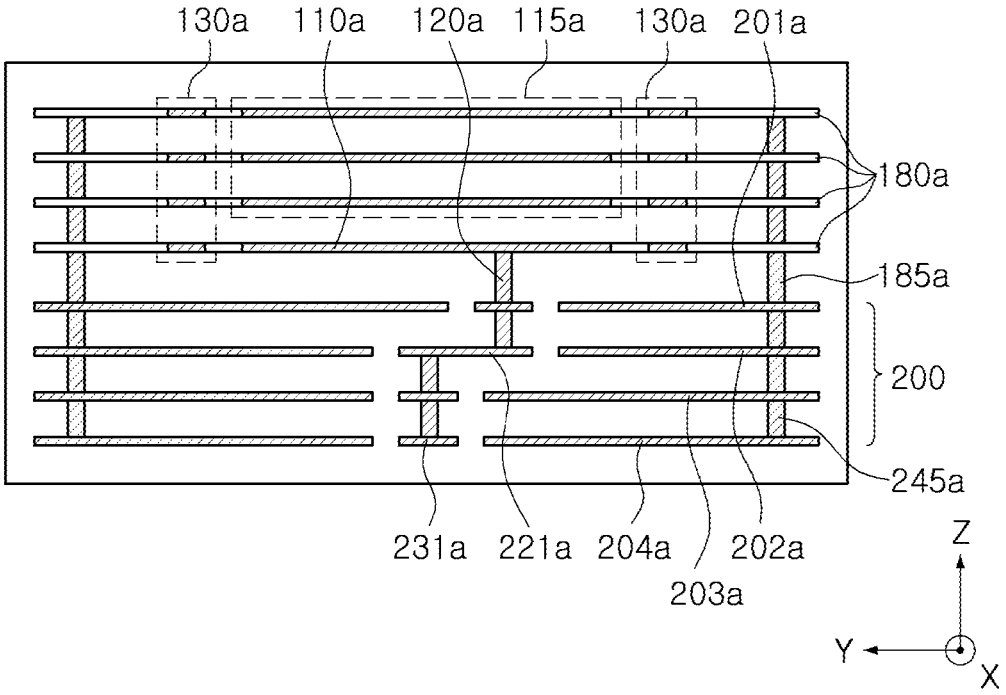
FIGS. 3A and 3B are side views illustrating an antenna apparatus taken in a first direction according to an example.
Figure 3B:
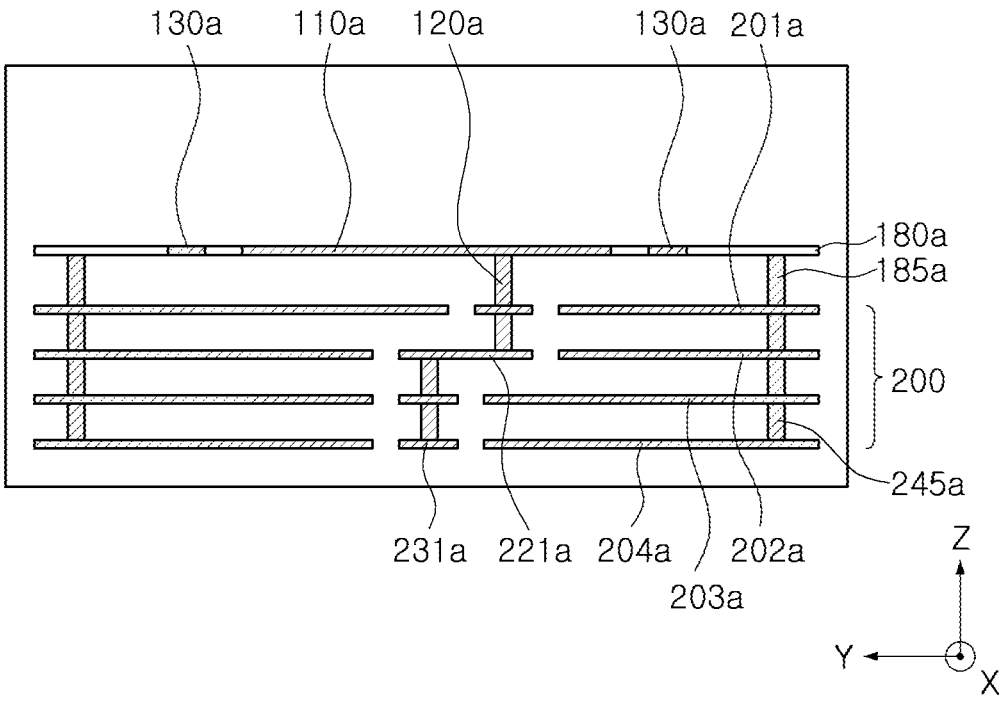
Figure 3C:
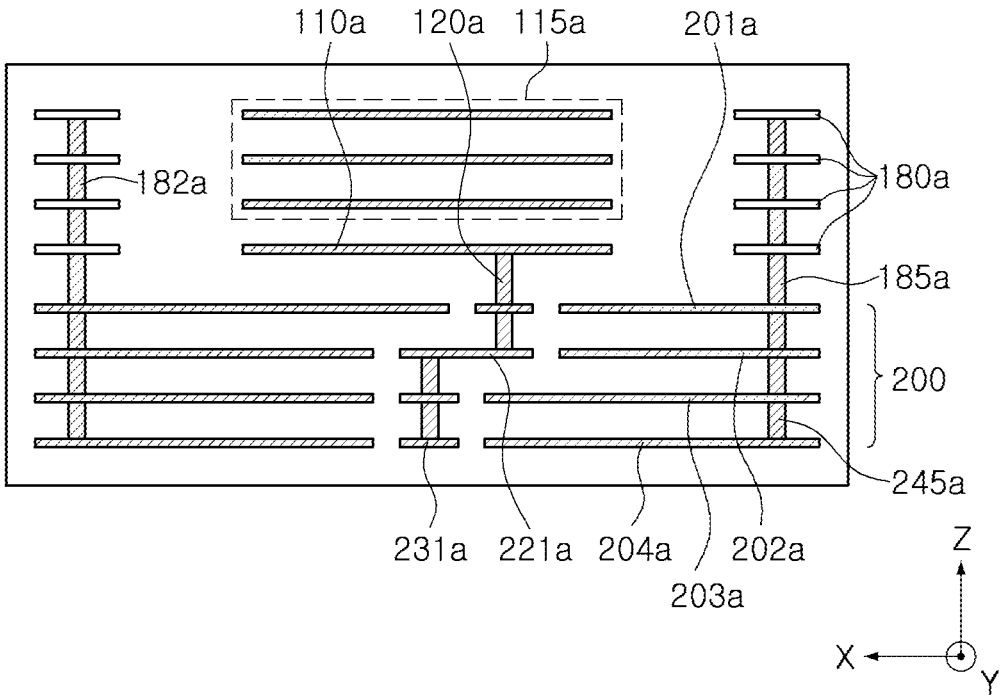
FIGS. 3C and 3D are side views illustrating an antenna apparatus taken in a second direction according to an example.
Figure 3D:
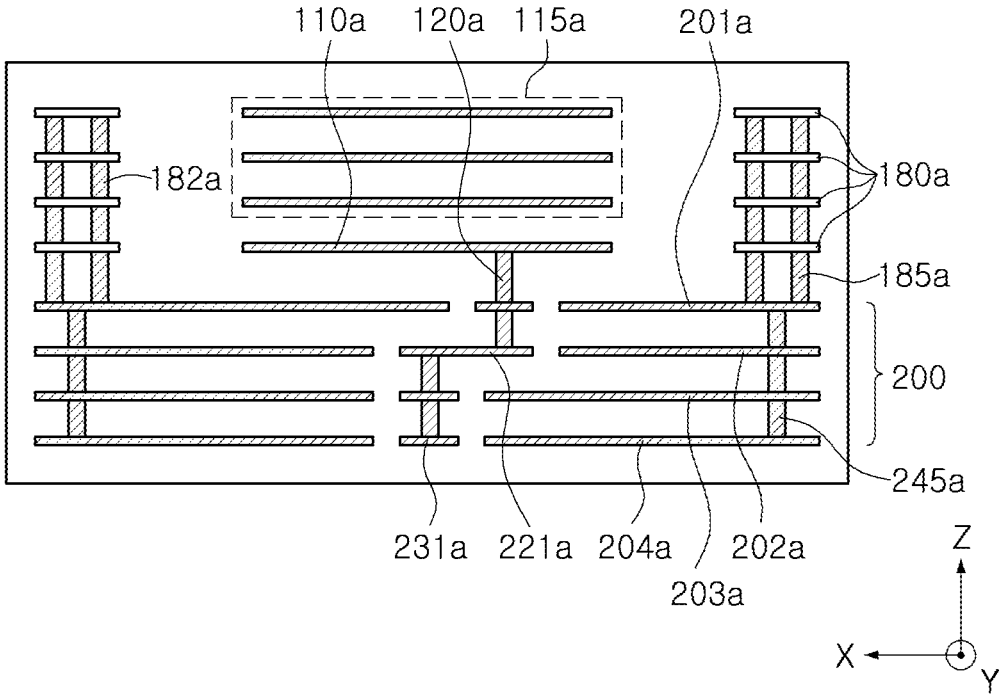

FIGS. 3A and 3B are side views illustrating an antenna apparatus taken in a first direction according to an example. FIGS. 3C and 3D are side views illustrating an antenna apparatus taken in a second direction according to an example.

Referring to FIGS. 3A, 3B, 3C, and 3D, the antenna apparatus may include a connection member 200. The connection member 200 may include a first ground plane 201*a*, a second ground plane 202*a*, a third ground plane 203*a*, a fourth ground plane 204*a*, and a shielding via 245*a*, and may provide a dispositional space for a first feed line 221*a* and a first wiring via 231*a*.

A lower surface of the connection member 200 may be used as a dispositional space of an IC. The IC may be electrically connected to the first wiring via 231*a*.

The first ground plane 201*a* may have a through-hole through which a first feed via 120*a* penetrates, and may block a region between the patch antenna pattern 110*a* and the first feed line 221*a*.

Accordingly, electromagnetic isolation between the first feed line 221*a* and the patch antenna pattern 110*a* may improve, and electromagnetic noise of an RF signal transmitted from the first feed line 221*a* may be reduced.

The first ground plane 201*a* may work as an electromagnetic reflector with respect to the patch antenna pattern 110*a*, and accordingly, a radiation pattern of the patch antenna pattern 110*a* may be focused on an upper side.

An upper coupling pattern 115*a* may be disposed on an upper side of the patch antenna pattern 110*a* and may be spaced apart from the patch antenna pattern 110*a*. Accordingly, the upper coupling pattern 115*a* may provide additional capacitance and/or inductance to the patch antenna pattern 110*a*. The additional capacitance and/or inductance may work as an additional resonance frequency of the patch antenna pattern 110*a*, thereby broadening a bandwidth of the patch antenna pattern 110*a*.

In various examples, the number of layers of the upper coupling patterns 115*a* may be two or more. The higher the number of layers of the upper coupling patterns 115*a*, the more the bandwidth of the patch antenna pattern 110*a* may be broadened.

In various examples, the number of layers of a plurality of side coupling patterns 130*a* may also be 2 or more. For example, a portion of the side coupling patterns 130*a* may be disposed on a level the same as a level of the patch antenna pattern 110*a*, and the other portion or a remaining portion may be disposed on a level the same as a level of the upper coupling pattern 115*a*.

Accordingly, the number of examples of combination of additional capacitance and/or inductance provided to the patch antenna pattern 110*a* may increase, and a bandwidth of the patch antenna pattern 110*a* may be broadened.

At least one of the side coupling patterns 130*a* may be separated from the first ground plane 201*a*.

Accordingly, the side coupling patterns 130*a* may focus more on an operation of being electromagnetically coupled to the patch antenna pattern 110*a* than an operation of preventing electromagnetic interference of the patch antenna pattern 110*a*, thereby improving a bandwidth of the patch antenna pattern 110*a*. The electromagnetic interference of the patch antenna pattern 110*a* may be prevented by a side ground pattern 180*a*.

The side ground patterns 180*a* may be disposed on different levels, and may be electrically connected to each other by a plurality of side ground vias 182*a* (see FIGS. 3C and 3D). The side ground patterns 180*a* may be electrically connected to the first ground plane 201*a* through the ground connection vias 185*a*.

Accordingly, electromagnetic bulk of the side ground patterns 180*a* may increase, and electromagnetic interference of the patch antenna pattern 110*a* taken in the first direction (e.g., an X direction) may be prevented three-dimensionally.

Figure 4A:
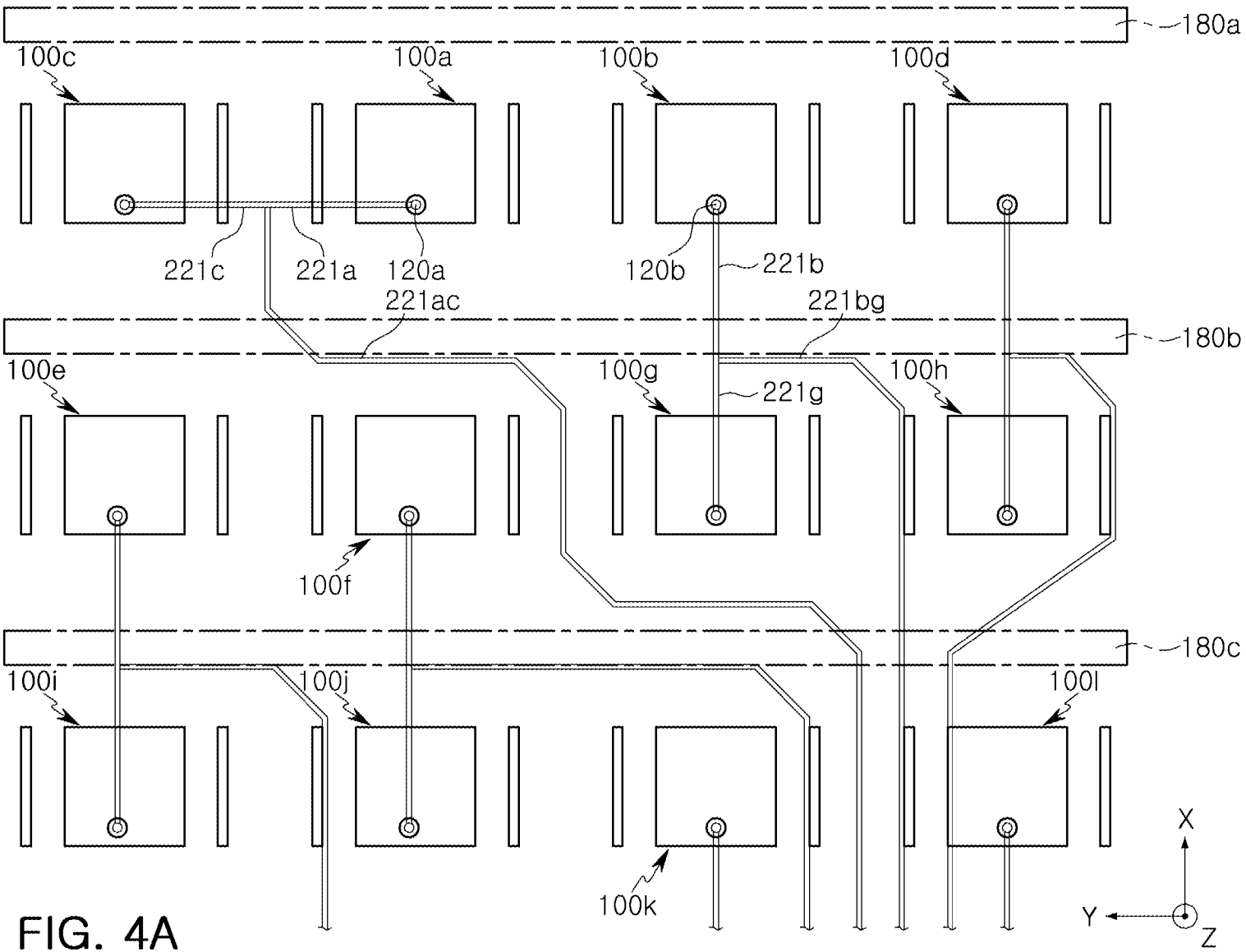
FIGS. 4A, 4B, and 4C are plan views illustrating an N×M matrix structure of an antenna apparatus according to an example.
Figure 4B:
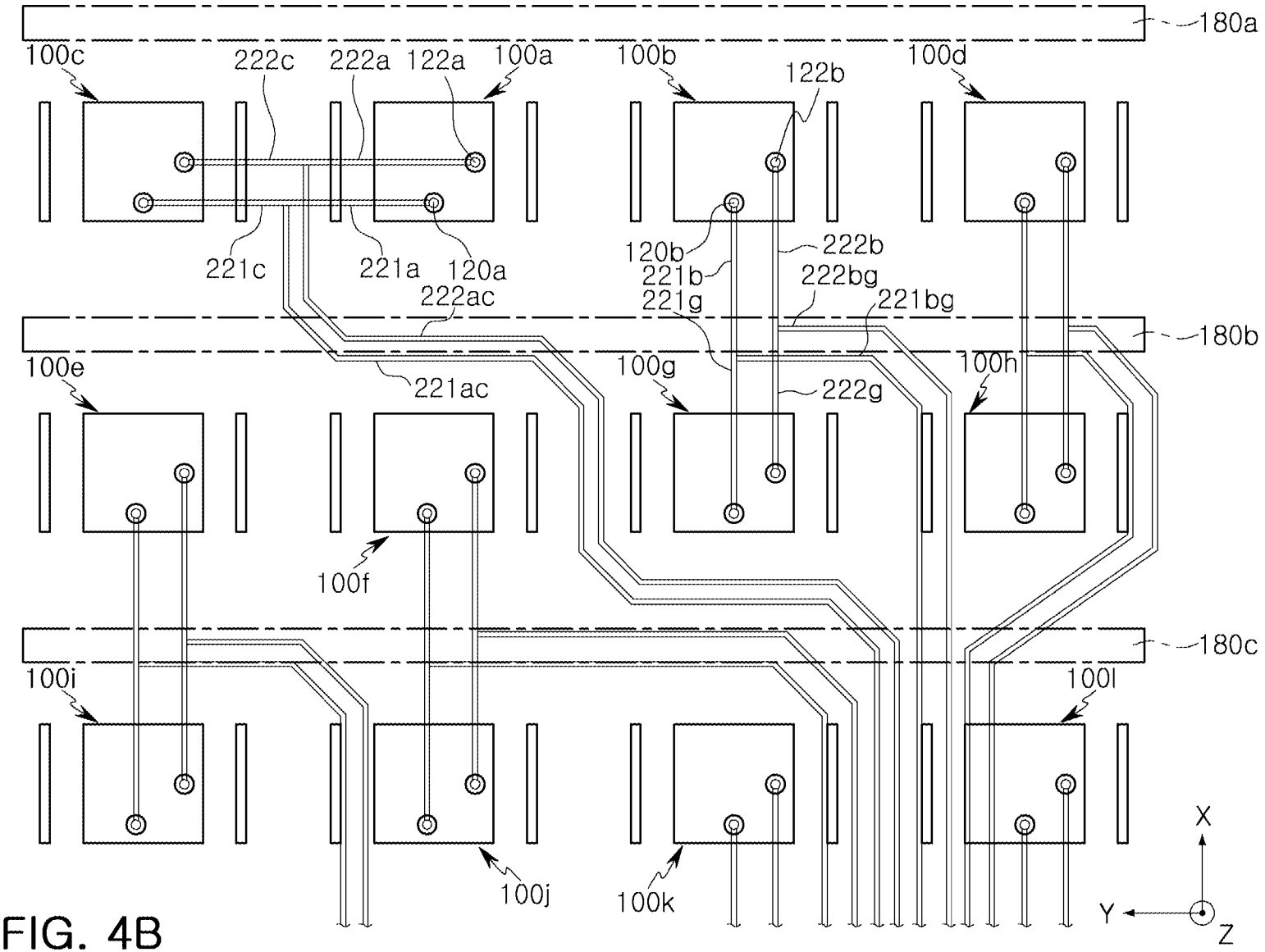
Figure 4C:
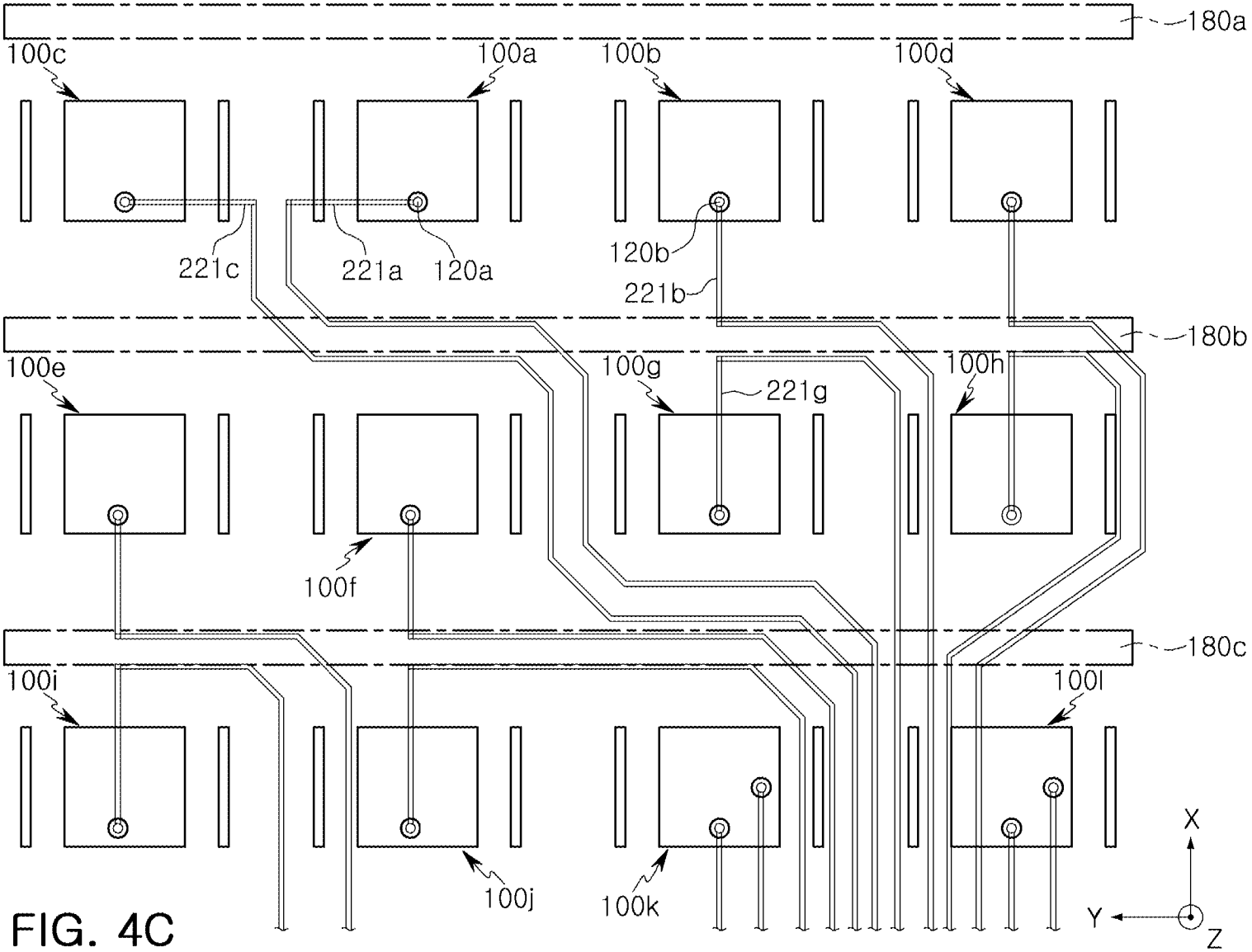

FIGS. 4A through 4C are plan views illustrating an N×M matrix structure of an antenna apparatus according to an example.

Referring to FIGS. 4A through 4C, an antenna apparatus may include a first antenna unit 100*a*, a second antenna unit 100*b*, a third antenna unit 100*c*, a fourth antenna unit 100*d*, a fifth antenna unit 100*e*, a sixth antenna unit 100*f*, a seventh antenna unit 100*g*, an eighth antenna unit 100*h*, a ninth antenna unit 100*i*, a tenth antenna unit 100*j*, an eleventh antenna unit 100*k*, and a twelfth antenna unit 100*l*.

For example, the first to twelfth antenna units 100*a*, 100*b*, 100*c*, 100*d*, 100*e*, 100*f*, 100*g*, 100*h*, 100*i*, 100*j*, 100*k*, and 100*l* may be arranged in N×M matrix structure. N may be 4, and M may be 3.

Each of the first to twelfth antenna units 100*a*, 100*b*, 100*c*, 100*d*, 100*e*, 100*f*, 100*g*, 100*h*, 100*i*, 100*j*, 100*k*, and 100*l* may include a plurality of patch antenna patterns which may be provided with vertical feed energy by corresponding feed vias and horizontal feed energy by corresponding feed lines and may radiate the energy.

For example, the first and third antenna units 100*a* and 100*c* may be included in a first group, and the second and fourth to twelfth antenna units 100*b*, 100*d*, 100*e*, 100*f*, 100*g*, 100*h*, 100*i*, 100*j*, 100*k*, and 100*l* may be included in a second group.

An extending direction of first feed lines 221*a* and 221*c* from a first feed via 120*a* corresponding to the first group may not form an angle of angle of 0° or 180° with an extending direction of first feed lines 221*b* and 221*g* from a first feed via 120*b* corresponding to the second group.

The first group may be only provided with the horizontal feed energy element in the first direction or a direction opposite to the first direction, and the second group may be only provided with the horizontal feed energy element in the second direction perpendicular to the first direction or a direction opposite to the second direction.

Accordingly, a side lobe generated in the first to twelfth antenna units 100*a*, 100*b*, 100*c*, 100*d*, 100*e*, 100*f*, 100*g*, 100*h*, 100*i*, 100*j*, 100*k*, and 100*l* may be removed or reduced.

Referring to FIGS. 4A and 4B, extending directions of a portion and the other portion of the first feed lines 221*a* and 221*c* corresponding to the first group from the first feed via 120*a* may be opposite to each other. A first coupling feed line 221*ac* may have a structure in which a portion and the other portion of the first feed lines 221*a* and 221*c* corresponding to the first group may be coupled to each other, and the first coupling feed line 221*ac* may be electrically connected to a first wiring via.

Accordingly, the plurality of feed lines may have a simplified structure such that a transmission loss of an RF signal in the plurality of feed lines may be reduced, and an overall area occupied by the plurality of feed lines may be reduced.

Extending directions of a portion and the other portion of the first feed lines 221*b* and 221*g*, corresponding to the second group from the first feed via 120*b* may be opposite to each other. A first coupling feed line 221*bg* may have a structure in which a portion and the other portion of the first feed lines 221*b* and 221*g* corresponding to the second group may be coupled to each other, and the first coupling feed line 221*bg* may be electrically connected to a first wiring via.

Referring to FIG. 4B, extending directions of a portion and the other portion of second feed lines 222*a* and 222*c* corresponding to the first group from a second feed via 122*a* may be opposite to each other. A second coupling feed line 222*ac* may have a structure in which a portion and the other portion of the second feed lines 222*a* and 222*c* corresponding to the first group may be coupled to each other, and the second coupling feed line 222*ac* may be electrically connected to a second wiring via.

Extending directions of a portion and the other portion of second feed lines 222*b* and 222*g* corresponding to the second group from a second feed via 122*b* may be opposite to each other. A second coupling feed line 222*bg* may have a structure in which a portion and the other portion of the second feed lines 222*b* and 222*g* corresponding to the second group may be coupled to each other, and the second coupling feed line 222*bg* may be electrically connected to a second wiring via.

Referring to FIG. 4C, the first and second coupling feed lines may be omitted.

As the antenna apparatus in the example may include the side ground patterns 180*a*, 180*b*, and 180*c*, electromagnetic interference between the first to twelfth antenna units 100*a*, 100*b*, 100*c*, 100*d*, 100*e*, 100*f*, 100*g*, 100*h*, 100*i*, 100*j*, 100*k*, and 100*l* working in the first direction (e.g., an X direction) may be prevented.

Figure 5:
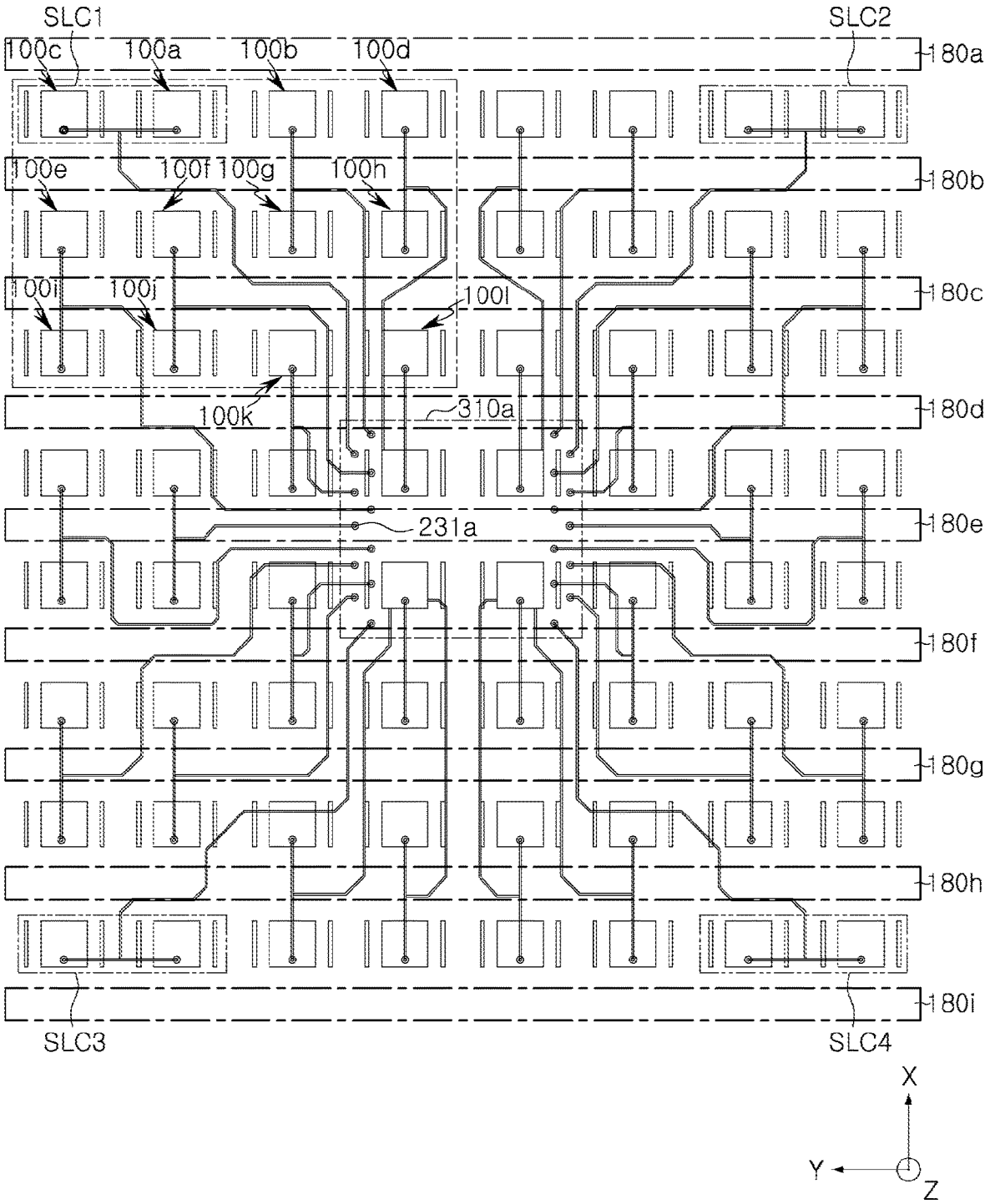
FIG. 5 is a plan view illustrating a corner region of an N×M matrix structure of an antenna apparatus according to an example.

FIG. 5 is a plan view illustrating a corner region of an N×M matrix structure of an antenna apparatus according to an example.

Referring to FIG. 5, an N×M matrix structure including first to twelfth antenna units 100*a*, 100*b*, 100*c*, 100*d*, 100*e*, 100*f*, 100*g*, 100*h*, 100*i*, 100*j*, 100*k*, and 100*l* may include a first corner region SLC1 of a first group, a second corner region SLC2 of the first group, a third corner region SLC3 of the first group, and a fourth corner region SLC4 of the first group, and may be electrically connected to an IC 310*a*.

The first corner region SLC1 of the first group may include elements (1, 1) of an N×M matrix structure, and the second corner region SLC2 of the first group may include elements (1, N) of an N×M matrix structure, the third corner region SLC3 of the first group may include elements (M, 1) of an N×M matrix structure, and the fourth corner region SLC4 of the first group may include elements (M, N) of an N×M matrix structure.

In various examples, at least one of the first, second, third, and fourth corner regions SLC1, SLC2, SLC3, and SLC4 of the first group may be included in the second group rather than the first group, and regions other than the first, second, third, and fourth corner regions SLC1, SLC2, SLC3, and SLC4 may be included in the second group in the N×M matrix structure.

The number of adjacent elements of the elements (1, 1), the elements (1, N), the elements (M, 1), and the elements (M, N) of the N×M matrix structure is 2, which may be less than the number of adjacent elements of the other elements. Accordingly, a surface current flowing on a patch antenna pattern of the elements (1, 1), the elements (1, N), the elements (M, 1), and the elements (M, N) of the N×M matrix structure and a surface current flowing on a patch antenna patter of the other elements may have slightly different properties. The slightly different properties may generate a side lobe.

The first group may be provided with a horizontal feed energy element in the first direction or a direction opposite to the first direction, and the second group may be provided with a horizontal feed energy element in a second direction perpendicular to the first direction or a direction opposite to the second direction.

Accordingly, the slightly different properties between a surface current flowing on a patch antenna pattern of the elements (1, 1), the elements (1, N), the elements (M, 1), and the elements (M, N) of the N×M matrix structure and a surface current of a patch antenna pattern of the other elements may be offset, thereby removing or reducing a side lobe.

As the antenna apparatus in the example may include a plurality of side ground patterns 180*a*, 180*b*, 180*c*, 180*d*, 180*e*, 180*f*, 180*g*, 180*h*, and 180*i*, electromagnetic interference between the M×N number of antenna units working in the first direction (e.g., an X direction) may be prevented.

Figure 6A:
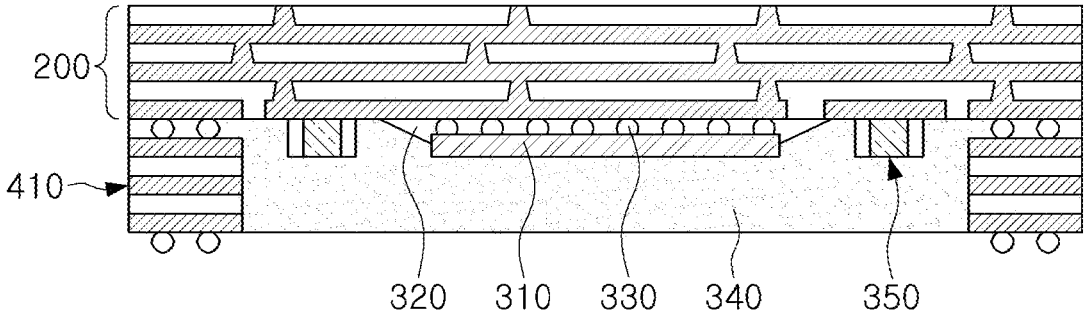
FIGS. 6A and 6B are side views illustrating a lower structure of a connection member included in an antenna apparatus according to an example.
Figure 6B:
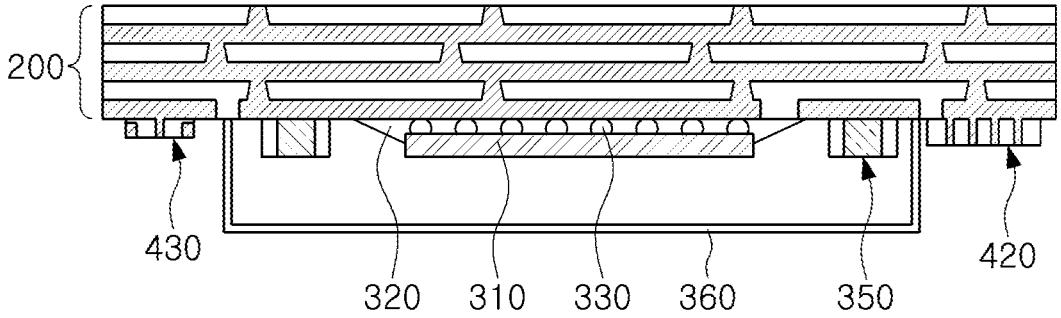

FIGS. 6A and 6B are side views illustrating a lower structure of a connection member included in an antenna apparatus according to an example.

Referring to FIG. 6A, the antenna apparatus may include at least portions of a connection member 200, an IC 310, an adhesive member 320, an electrical interconnect structure 330, an encapsulant 340, a passive component 350, and a core member 410.

The connection member 200 may have a structure similar to the structure of the connection member described with reference to FIGS. 3A through 3D.

The IC 310 may be the same as the above-described IC, and may be disposed on a lower side of the connection member 200. The IC 310 may be electrically connected to a wiring line of the connection member 200, and may transmit or receive an RF signal. The IC 310 may also be electrically connected to a ground plane of the connection member 200 and may be grounded. For example, the IC 310 may generate a converted signal by performing at least portions of frequency conversion, amplification, filtering, a phase control, and power generation.

The adhesive member 320 may allow the IC 310 and the connection member 200 to be bonded to each other.

The electrical interconnect structure 330 may electrically connect the IC 310 and the connection member 200 to each other. The electrical interconnect structure 330 may have a structure such as a solder ball, a pin, a land, and a pad. The electrical interconnect structure 330 may have a melting point lower than melting points of a wiring line and a ground plane of the connection member 200 and may electrically connect the IC 310 and the connection member 200 to each other through a required process using the low melting point.

The encapsulant 340 may encapsulate at least a portion of the IC 310, and may improve heat dissipation performance and protection performance against impacts. For example, the encapsulant 340 may be implemented by a photoimageable encapsulant (PIE), an Ajinomoto build-up film (ABF), an epoxy molding compound (EMC), and the like.

The passive component 350 may be disposed on a lower surface of the connection member 200, and may be electrically connected to a wiring line and/or a ground plane of the connection member 200 through the interconnect structure 330. For example, the passive component 350 may include at least portions of a capacitor (e.g., a multilayer ceramic capacitor, MLCC), an inductor, and a chip resistor.

The core member 410 may be disposed on a lower surface of the connection member 200, and may be electrically connected to the connection member 200 to receive an intermediate frequency (IF) signal or a baseband signal from an external entity and to transmit the signal to the IC 310, or to receive an IF signal or a baseband signal from the IC 310 and to transmit the signal to an external entity. A frequency (e.g., 24 GHz, 28 GHz, 36 GHz, 39 GHz, 60 GHz) of the RF signal may be greater than a frequency (e.g., 2 GHz, 5 GHz, 10 GHz, and the like) of the IF signal.

For example, the core member 410 may transmit an IF signal or a baseband signal to the IC 310 or may receive the signal from the IC 310 through a wiring line included in an IC ground plane of the connection member 200. As a first ground plane of the connection member 200 is disposed between the IC ground plane and a wiring line, an IF signal or a baseband signal and an RF signal may be electrically isolated from each other in an antenna module.

Referring to FIG. 6B, the antenna apparatus may include at least portions of a shielding member 360, a connector 420, and a chip antenna 430.

The shielding member 360 may be disposed on a lower side of the connection member 200 and may enclose the IC 310 along with the connection member 200. For example, the shielding member 360 may cover or conformally shield the IC 310 and the passive component 350 together, or may separately cover or compartment-shield the IC 310 and the passive component 350. For example, the shielding member 360 may have a hexahedral shape in which one surface is open, and may define an accommodating space having a hexahedral form by being combined with the connection member 200. The shielding member 360 may be implemented by a material having relatively high conductivity such as copper, such that the shielding member 360 may have a skin depth, and the shielding member 360 may be electrically connected to a ground plane of the connection member 200. Accordingly, the shielding member 360 may reduce electromagnetic noise which the IC 310 and the passive component 350 receive.

The connector 420 may have a connection structure of a cable (e.g., a coaxial cable or a flexible PCB), may be electrically connected to the IC ground plane of the connection member 200, and may work similarly to the above-described sub-substrate. Accordingly, the connector 420 may be provided with an IF signal, a baseband signal, and/or power from a cable, or may provide an IF signal and/or a baseband signal to a cable.

The chip antenna 430 may transmit or receive an RF signal in addition to the antenna apparatus. For example, the chip antenna 430 may include a dielectric block having a dielectric constant higher than that of an insulating layer, and a plurality of electrodes disposed on both surfaces of the dielectric block. One of the plurality of electrodes may be electrically connected to a wiring line of the connection member 200, and the other one of the plurality of electrodes may be electrically connected to a ground plane of the connection member 200.

Figure 7:
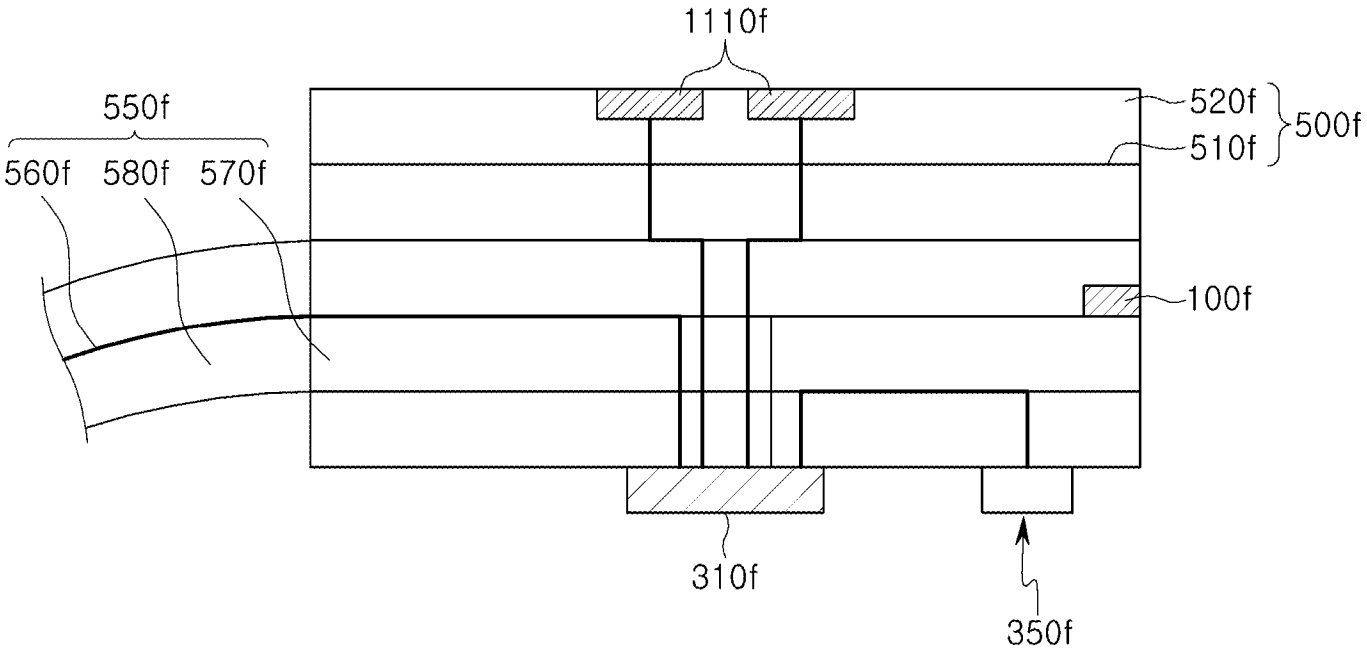
FIG. 7 is a side view illustrating an example structure of an antenna apparatus according to an example.

FIG. 7 is a side view illustrating an example of a structure of an antenna apparatus according to an example.

The antenna apparatus may have a structure in which an end-fire antenna 100*f*, a patch antenna pattern 1110*f*, an IC 310*f*, and a passive component 350*f* are integrated in a connection member 500*f*.

The end-fire antenna 100*f* and the patch antenna pattern 1110*f* may be configured the same as the antenna apparatus and the patch antenna pattern described in the aforementioned examples, may receive an RF signal from the IC 310*f* and may transmit the RF signal, or may transmit a received RF signal to the IC 310*f*.

The connection member 500*f* may have a structure in which at least one conductive layer 510*f* and at least one insulating layer 520*f* are laminated (e.g., a structure of a printed circuit board). The conductive layer 510*f* may have the ground plane and the feed line described in the aforementioned examples.

The antenna apparatus may further include a flexible connection member 550*f*. The flexible connection member 550*f* may include a first flexible region 570*f* overlapping the connection member 500*f* and a second flexible region 580*f* which does not overlap the connection member 500*f* in upward and downward directions.

The second flexible region 580*f* may be flexibly bent in upward and downward directions. Accordingly, the second flexible region 580*f* may be flexibly connected to a connector of a set substrate and/or an adjacent antenna apparatus.

The flexible connection member 550*f* may include a signal line 560*f*. An intermediate frequency (IF) signal and/or a baseband signal may be transmitted to the IC 310*f* or may be transmitted to a connector of a set substrate and/or an adjacent antenna apparatus through the signal line 560*f*.

Figure 8A:
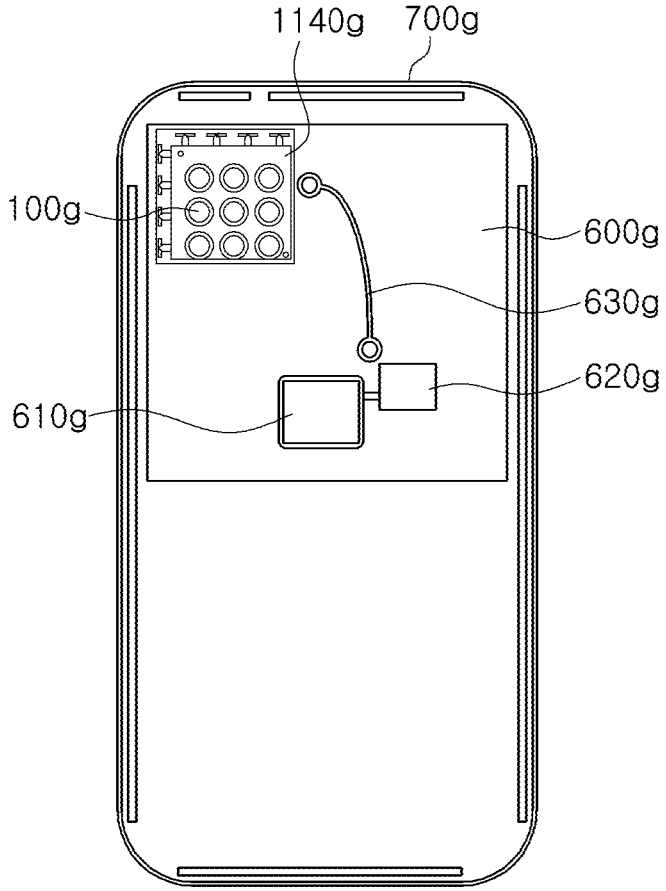
FIGS. 8A, 8B, and 8C are plan views illustrating an example of an electronic device in which an antenna apparatus is disposed.
Figure 8B:
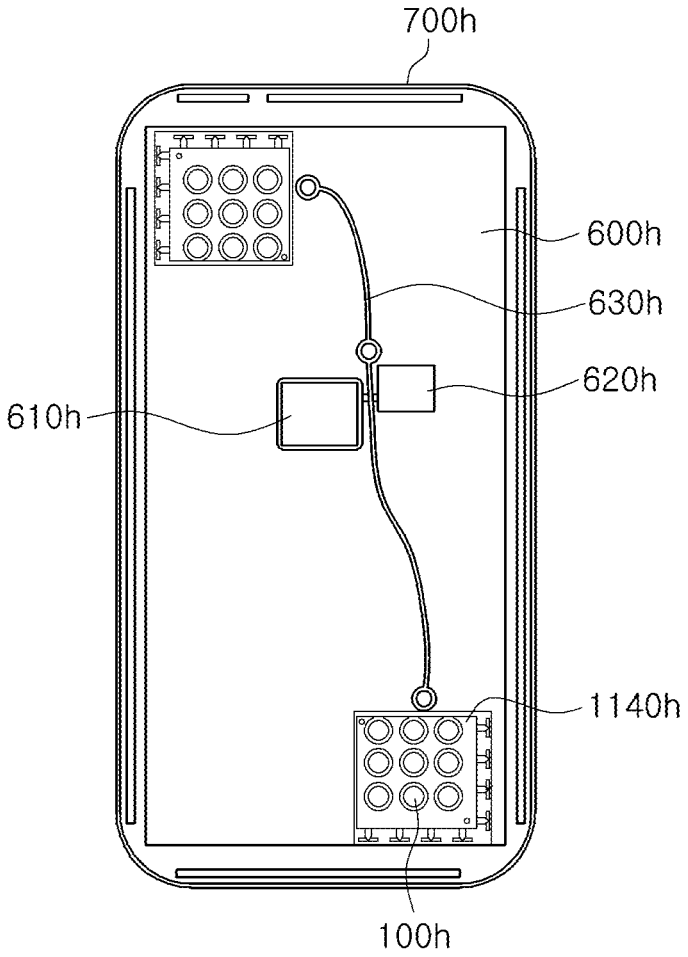
Figure 8C:
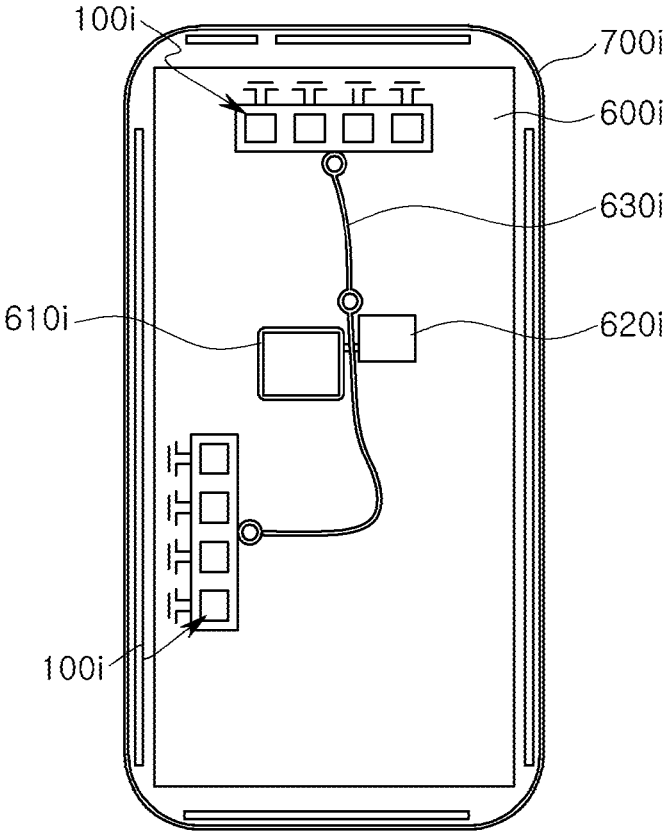

FIGS. 8A through 8C are plan views illustrating an example of an electronic device in which an antenna apparatus is disposed.

Referring to FIG. 8A, an antenna apparatus 1140*g* including an antenna unit 100*g* may be disposed adjacent to a side surface boundary of an electronic device 700*g* on a set substrate 600*g* of the electronic device 700*g*.

The electronic device 700*g* may be implemented as a smartphone, a personal digital assistant, a digital video camera, a digital still camera, a network system, a computer, a monitor, a tablet PC, a laptop PC, a netbook PC, a television, a video game, a smart watch, an automotive component, or the like, but an example of the electronic device 700*g* is not limited thereto.

A communication module 610*g* and a baseband circuit 620*g* may further be disposed on the set substrate 600*g*. The antenna apparatus 1140*g* may be electrically connected to the communication module 610*g* and/or the baseband circuit 620*g* through a coaxial cable 630*g*.

The communication module 610*g* may include at least portions of a memory chip such as a volatile memory (e.g., a DRAM), a non-volatile memory (e.g., a ROM), a flash memory, or the like; an application processor chip such as a central processor (e.g., a CPU), a graphics processor (e.g., a GPU), a digital signal processor, a cryptographic processor, a microprocessor, a microcontroller, or the like; and a logic chip such as an analog-to-digital converter, an application-specific integrated circuit (ASIC), or the like.

The baseband circuit 620*g* may generate a base signal by performing analog-to-digital conversion, and amplification, filtering, and frequency conversion on an analog signal. A base signal input to and output from the baseband circuit 620*g* may be transferred to the antenna apparatus 1140*g* through a cable.

For example, the base signal may be transferred to an IC through an electrical interconnect structure, a cover via, and a wiring line. The IC may convert the base signal into an RF signal of mmWave band.

Referring to FIG. 8B, a plurality of antenna apparatuses 1140*h* each including an antenna unit 100*h* may be disposed adjacent to a one side boundary and the other side boundary of an electronic device 700*h* on a set substrate 600*h* of the electronic device 700*h*, and a communication module 610*h* and a baseband circuit 620*h* may further be disposed on the set substrate 600*h*. The plurality of antenna apparatuses 1140*h* may be electrically connected to the communication module 610*h* and/or baseband circuit 620*h* through a coaxial cable 630*h*.

Referring to FIG. 8C, a plurality of antenna apparatuses each including an antenna unit 100*i* may be disposed adjacent to centers of sides of an electronic device 700*i* having a polygonal shape, respectively, on a set substrate 600*i* of the electronic device 700*i*, and a communication module 610*i* and a baseband circuit 620*i* may further be disposed on the set substrate 600*i*. The antenna apparatus may be electrically connected to the communication module 610*i* and/or the baseband circuit 620*i* through a coaxial cable 630*i*.

The patch antenna pattern, the side ground pattern, the side ground via, the ground connection via, the upper coupling pattern, the side coupling pattern, the feed via, the shielding via, the wiring via, the feed line, the ground plane, the end-fire antenna pattern, and the electrical interconnect structure may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) method, a physical vapor deposition (PVD) method, a sputtering method, a subtractive method, an additive method, a semi-additive process (SAP), a modified semi-additive process (MSAP), or the like, but examples of the material and the method are not limited thereto.

An insulating layer and/or a dielectric layer may be disposed in a position in which the patch antenna pattern, the side ground pattern, the side ground via, the ground connection via, the upper coupling pattern, the side coupling pattern, the feed via, the shielding via, the wiring via, the feed line, the ground plane, the end-fire antenna pattern, and the electrical interconnect structure are not disposed. The dielectric layer and/or the insulating layer described in the example embodiments may be implemented by a material such as FR4, a liquid crystal polymer (LCP), low temperature co-fired ceramic (LTCC), a thermosetting resin such as an epoxy resin, a thermoplastic resin such as a polyimide resin, a resin in which the above-described resin is impregnated in a core material, such as a glass fiber (or a glass cloth or a glass fabric), together with an inorganic filler, prepreg, a Ajinomoto build-up film (ABF), FR-4, bismaleimide triazine (BT), a photoimagable dielectric (PID) resin, a general copper clad laminate (CCL), glass or a ceramic-based insulating material, or the like.

The RF signal described in the various examples may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+ (HSPA+), high speed downlink packet access+ (HSDPA+), high speed uplink packet access+ (HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the above-mentioned protocols, but an example embodiment thereof is not limited thereto.

According to the aforementioned examples, the antenna apparatus may have improved antenna performances (e.g., a gain, a bandwidth, directivity, and the like) and may be easily miniaturized.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a plurality of patch antenna patterns including M number of patch antenna patterns arranged in a first direction and N number of patch antenna patterns arranged in a second direction, where M and N are natural numbers;

a plurality of side coupling patterns coplanar with the plurality of patch antenna patterns and spaced apart from the plurality of patch antenna patterns along the second direction such that at least one of the plurality of side coupling patterns is disposed between adjacent patch antenna patterns along the second direction, each of the side coupling patterns being electromagnetically coupled to one of the patch antenna patterns in the second direction; and a side ground pattern disposed between the plurality of patch antenna patterns with respect to the first direction and disposed between the plurality of side coupling patterns with respect to the first direction, wherein the plurality of side coupling patterns have a same height as the plurality of patch antenna patterns, and are floating conductive patterns.

2. The antenna apparatus of claim 1, wherein a width of the side ground pattern in the first direction is greater than a width of each of the side coupling patterns in the second direction.

3. The antenna apparatus of claim 1, wherein a spacing distance between the side ground pattern and each of the patch antenna patterns in the first direction is greater than a spacing distance between each of the side coupling patterns and the patch antenna patterns in the second direction.

4. The antenna apparatus of claim 1, wherein a length of the side ground pattern along the second direction is greater than a distance, along the second direction, from an end of a first outermost patch antenna pattern, from among the plurality of patch antenna patterns, to an end of a second outermost patch antenna pattern, from among the plurality of patch antenna patterns.

5. The antenna apparatus of claim 1, further comprising:

a ground plane spaced apart from the plurality of patch antenna patterns in a third direction; and a ground connection via electrically connecting the ground plane and the side ground pattern to each other.

6. The antenna apparatus of claim 5, wherein at least one of the side coupling patterns is separated from the ground plane.

7. The antenna apparatus of claim 1, further comprising:

a plurality of feed vias, each feed via being electrically connected to a corresponding patch antenna pattern of the plurality of patch antenna patterns; and a plurality of feed lines, each feed line being electrically connected to a corresponding feed via of the plurality of feed vias and disposed perpendicularly to the corresponding feed via, wherein each of the feed lines perpendicularly extends from the corresponding feed via.

8. The antenna apparatus of claim 7, further comprising:

a ground plane having at least one through-hole through which the plurality of feed vias penetrate, the ground plane being disposed between the plurality of feed lines and the plurality of patch antenna patterns.

9. The antenna apparatus of claim 8, wherein at least one of the M number and the N number is a natural number greater than or equal to 3, and wherein a direction in which a first feed line, from among the plurality of feed lines, electrically connected to a patch antenna pattern of the plurality of patch antenna patterns disposed most adjacent to one corner of the ground plane extends is perpendicular to a direction in which a second feed line, from among the plurality of feed lines, electrically connected to a patch antenna pattern of the plurality of patch antenna patterns disposed most adjacent to a center of the ground plane extends.

10. The antenna apparatus of claim 8, further comprising:

a plurality of first wiring vias, each first wiring via being electrically connected to a corresponding feed line of the plurality of feed lines; and an integrated circuit electrically connected to the plurality of first wiring vias.

* * * * *